US007563048B2

(12) United States Patent
Koptis

(10) Patent No.: US 7,563,048 B2
(45) Date of Patent: Jul. 21, 2009

(54) TWIST-OPEN DISPENSER WITH APPLICATOR & METHOD OF APPLYING SKIN CARE PRODUCTS & METHOD OF MERCHANDISING PAINT

(75) Inventor: Kurt Koptis, Yucca Valley, CA (US)

(73) Assignee: Platinum Innovations, Inc., Yucca Valley, CA (US)

( * ) Notice: Subject to any disclaimer, the term of this patent is extended or adjusted under 35 U.S.C. 154(b) by 593 days.

(21) Appl. No.: 11/155,015

(22) Filed: Jun. 16, 2005

(65) Prior Publication Data

US 2006/0285913 A1 Dec. 21, 2006

(51) Int. Cl.
*B43M 11/06* (2006.01)

(52) U.S. Cl. ..... 401/202; 401/205; 401/207; 401/183

(58) Field of Classification Search ..... 401/202, 401/205, 207, 183, 184, 186, 269, 280, 281
See application file for complete search history.

(56) References Cited

U.S. PATENT DOCUMENTS

| | | | | |
|---|---|---|---|---|
| 1,042,032 | A | | 10/1912 | Pederson |
| 1,725,464 | A | * | 8/1929 | Lysons ..... 401/288 |
| D188,397 | S | | 7/1960 | Hulsh |
| 2,962,743 | A | | 12/1960 | Henriksson |
| 3,016,561 | A | | 1/1962 | Hulsh |
| 3,072,953 | A | | 1/1963 | Bunke |
| 3,121,906 | A | * | 2/1964 | Hulsh ..... 401/202 |
| 3,486,666 | A | | 12/1969 | Herzig et al. |
| 3,756,732 | A | | 9/1973 | Stoffler |
| 4,089,609 | A | | 5/1978 | Gring et al. |
| 4,726,386 | A | * | 2/1988 | Schultz ..... 132/317 |
| 4,748,990 | A | * | 6/1988 | Brown et al. ..... 132/320 |
| 4,762,433 | A | | 8/1988 | Bergeson et al. |
| 4,964,548 | A | | 10/1990 | Kenyon, Jr. |
| D346,959 | S | | 5/1994 | Adams |
| D351,338 | S | | 10/1994 | Koptis |
| 5,577,851 | A | | 11/1996 | Koptis |
| D376,048 | S | | 12/1996 | Gerthart et al. |
| 5,988,923 | A | | 11/1999 | Arai |
| 6,053,184 | A | | 4/2000 | DeVone |
| 6,086,278 | A | | 7/2000 | Keller |
| 6,123,477 | A | | 9/2000 | Hecker |
| D481,166 | S | | 10/2003 | Angeletta |
| D487,637 | S | | 3/2004 | Price |

* cited by examiner

*Primary Examiner*—David J Walczak
(74) *Attorney, Agent, or Firm*—John J. Connors; Connors & Assoc.

(57) ABSTRACT

A dispenser cap with an applicator is connected to a container and a detachable enclosure protects the applicator when the dispenser is not in use. When attached to the cap, the enclosure has a pin that blocks an opening in the cap. The container may hold any fluid material, for example, a skin care product, deodorant, paint, etc. The container may contain various means of identifying the color of paint contained therein, and only a small amount of paint is within the container. This enables a consumer to obtain a number of containers each holding a paint of a different color to apply to a test surface.

1 Claim, 17 Drawing Sheets

Fig. 7A
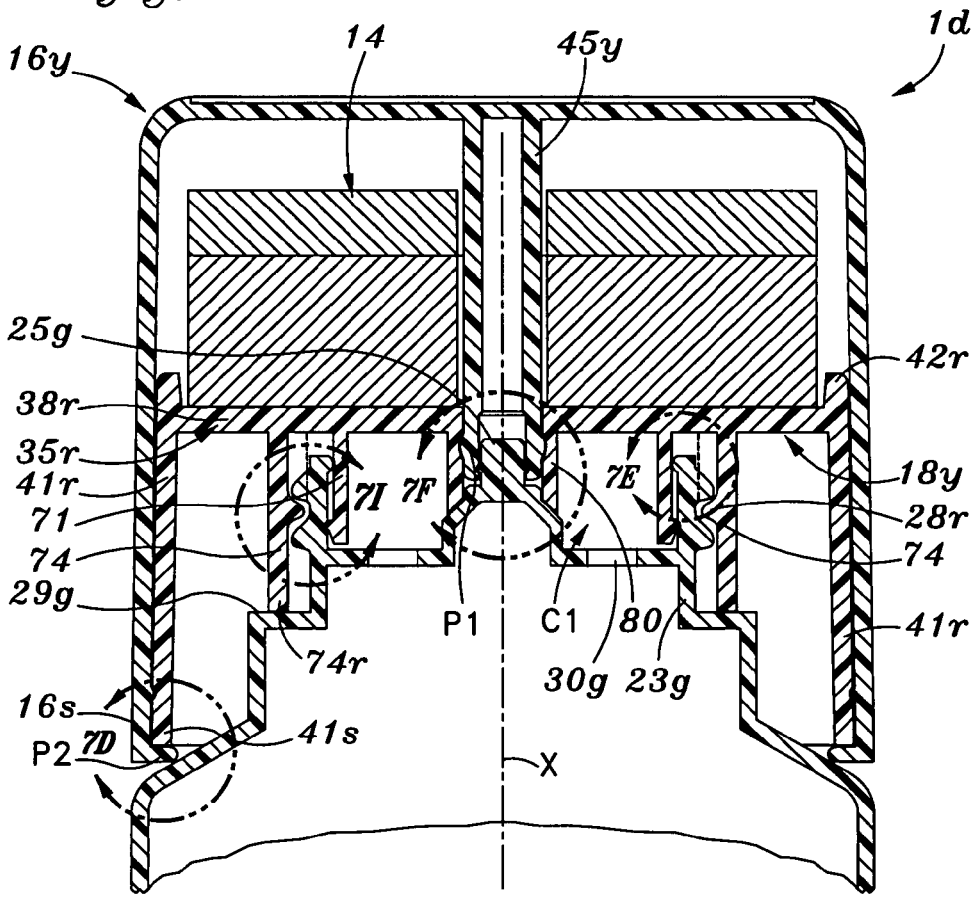
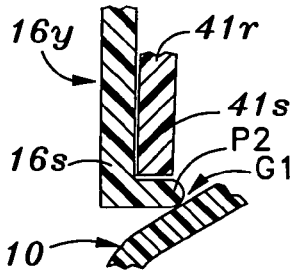
Fig. 7D
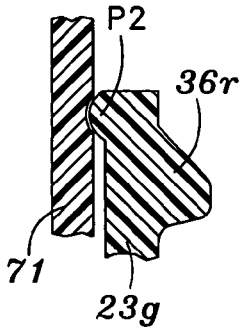
Fig. 7E
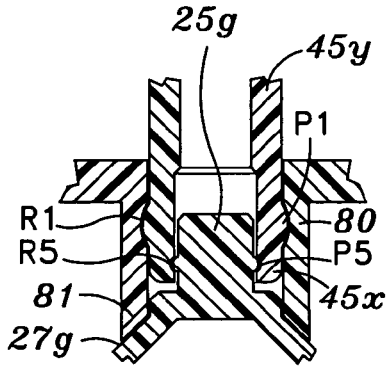
Fig. 7F

Fig. 7B
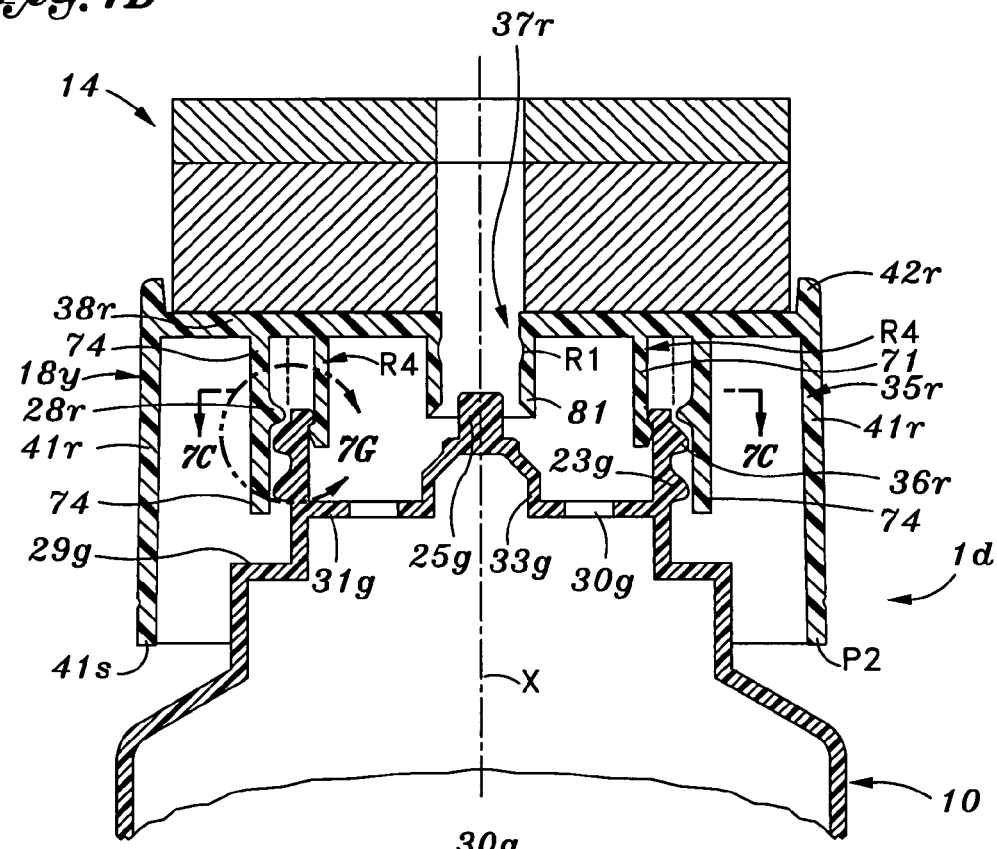
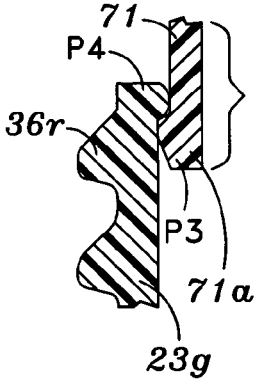
Fig. 7G
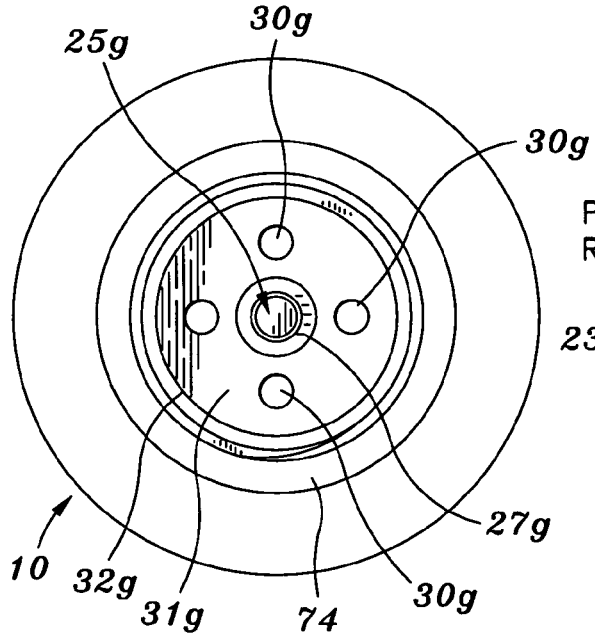
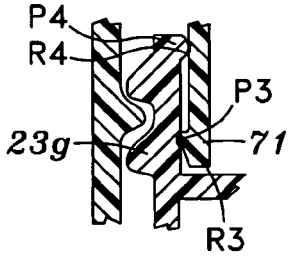
Fig. 7I
Fig. 7C

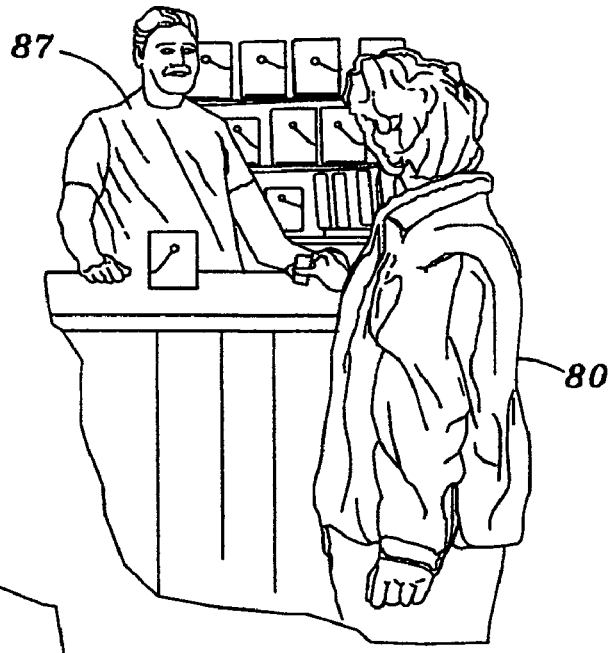
Fig. 17A
Fig. 17B
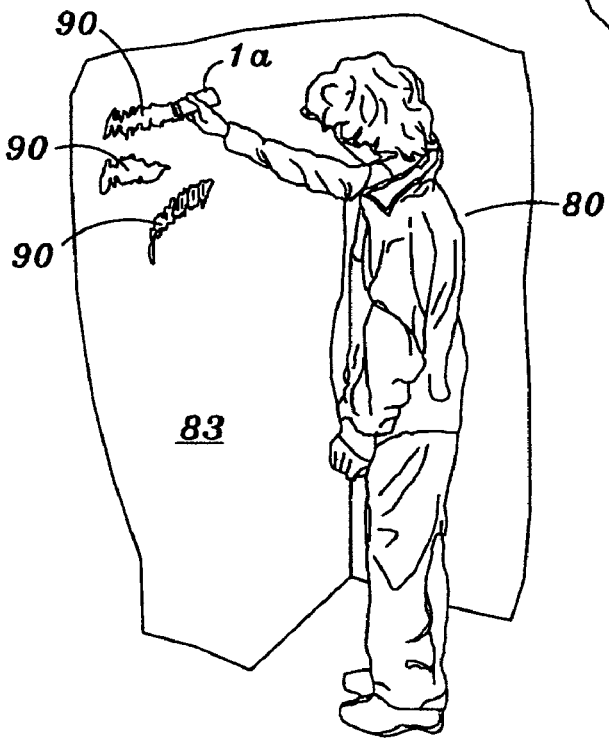
Fig. 17C
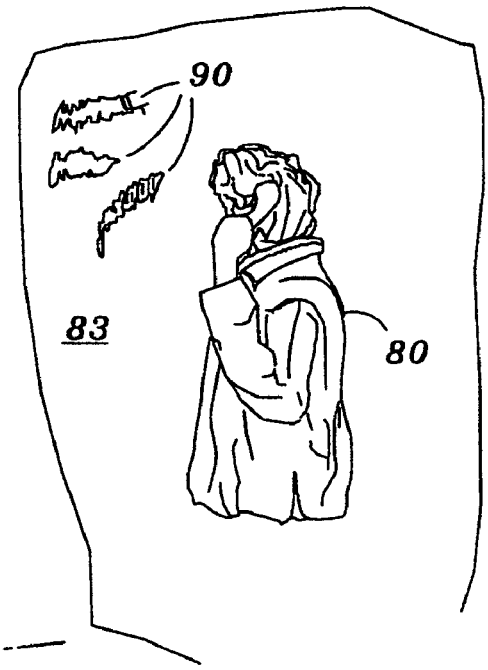
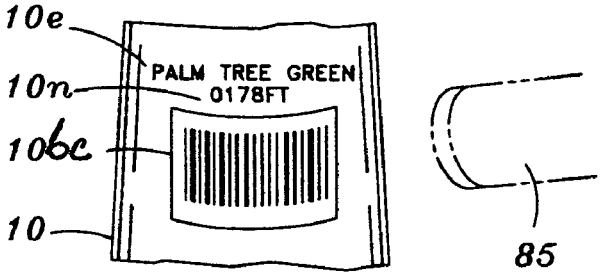
Fig. 17D

TWIST-OPEN DISPENSER WITH APPLICATOR & METHOD OF APPLYING SKIN CARE PRODUCTS & METHOD OF MERCHANDISING PAINT

RELATED DISCLOSURE DOCUMENT & INCORPORATION BY REFERENCE

This dispenser to which this application is directed was disclosed in Disclosure Document No. 540632 deposited on Oct. 22, 2003, with United States Patent and Trademark Office. This disclosure document is incorporated herein by reference and made a part of this application. If any conflict arises between the disclosure of the invention in this utility application and that in the disclosure document, the disclosure in this utility application shall govern.

DEFINITIONS

The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items.

"Rectangular shape" includes square shape.

"Paint color(s)" includes both the pigment of the paint as well as the gloss level.

BACKGROUND OF INVENTION

Dispensers with an applicator attached to a container are known for dispensing a wide variety of fluid materials held within the container such as, for example, (a) skin care products such as, for example, cosmetics, micro-dermal abrasive solutions, antiseptics, ointments, creams, topical solutions, etc. (b) deodorant, (c) depilatory creams, (d) shoe cleaners and polish, (e) coatings such as, for example, paint, stains, varnish, liquid wax, many types of chemicals, etc. Sometimes these dispensers leak. Moreover, it would be desirable to have a dispenser particularly useful for sampling different paint colors by applying different colors to various surfaces. For example, when a consumer desires to paint an object, they go to a hardware or paint store where they browse through hundreds of different color samples on small cards. After narrowing their choices down to a few colors they select the corresponding cards having the desired choices. The cards are then brought to the item to be painted where they are held up next to the object they intend to paint. Unfortunately at no point in this process is the consumer able to see what the paint will actually look like on the object they intend to paint. Additionally, the paint on the cards often does not come in the different gloss levels and this further adversely affects the selection process, perhaps resulting in a paint selection that is undesired.

SUMMARY OF INVENTION

This invention provides a dispenser that may be used to dispense and apply a wide variety of fluid materials, including, but not limited to, skin care products, liquid wax, stains, varnish, depilatory creams, gels of many types, micro-dermal abrasive solutions, shoe cleaning chemicals, paint, deodorant, etc. The dispenser is designed so the consumer may control when the contents of the container are dispensed and, until then, the contents are safely sealed therein. Additionally, the dispenser includes an applicator adapted to apply the fluid material within the container directly to a desired surface.

One embodiment of the dispenser of this invention comprises a container adapted to hold a fluid material, a cap attached to a dispensing end of the container, and a detachable top enclosure mounted to the cap. The cap includes a base member and a cover member and a passageway there through which allows the fluid material to flow out of the container and onto the desired surface. The base member is attached to the dispensing end of the container and the cover member is attached to the base member. The exterior of the cover member has an applicator element onto which flows the material exiting the container. The base and cover members are mounted to each other to be rotated between a closed position preventing the flow of the fluid material through the passageway and an open position allowing the flow of material from the container and through the passageway onto the applicator element. The detachable top enclosure covers the applicator element and at least partially blocks the passageway.

The invention has one or more features as discussed subsequently herein. After reading the following section entitled "DETAILED DESCRIPTION OF SOME EMBODIMENTS OF THIS INVENTION," one will understand how the features of this invention provide its benefits. The benefits of this invention include, but are not limited to: (a) providing a dispenser that has a cap that is normally closed but may be opened to allow a consumer to dispense a fluid material, (b) providing a dispenser that has a cap that may be opened or closed, and when closed fluid material in the dispenser does not leak, (c) providing a detachable enclosure for a dispenser that includes an abrasive surface for filing, sanding, smoothing, or any other similar purpose, (d) providing a detachable enclosure including an internal pin that helps keep the dispenser sealed, (e) providing an applicator that is made of a soft material that is capable of absorbing and spreading fluid material being dispensed and that accommodates an internal pin in a dispenser top enclosure, (f) providing an applicator that may be made of a stiffer material, for example, flexible bristles, that is capable of scrubbing a surface in order to clean it, (g) providing a dispenser with multiple barriers or seals inhibiting or preventing leakage, (h) providing a dispenser for paint that has more functionality than a standard paint can by not only providing a device for storing the paint but also including an attached applicator, (i) providing a method that allows a consumer to sample different paint colors by applying a selected paint color contained within the dispenser to an object to be painted via an attached applicator, (j) providing an applicator that is made of a rigid material, for example, plastic, that has a dome shape and a plurality of openings to be used as a deodorant applicator, and (k) having a top enclosure that protects the applicator, seal the container and provides storage for additional replacement applicators.

Without limiting the scope of this invention as expressed by the claims that follow, some, but not necessarily all, of its features are:

One, the container is adapted to hold a fluid material and has a dispensing end from which this material is dispensed. A cap is attached to the dispensing end and it may include a base member and a cover member attached to the base member. The base and cover members may be mounted to move relative to each other, so that in a first position the flow of material is prevented and in a second position the flow of material is allowed. These members may each have an opening therein, and they may be operatively connected in such a manner that their respective openings are aligned with each other. The base and cover members may be mounted to rotate relative to each other to move between the first and second positions, maintaining the alignment of the openings during rotational movement. The base member may be fixedly attached to the container. Rotating the cover member in one direction relative to the base member causes the cover member and base member to separate from each other but not change the alignment of their openings. Such separation of these members opens the dispenser, moving from the first position in which the cap is sealed and no fluid material can escape to the second position in which the consumer is able to release the fluid material from within the container, for example, by squeezing the container. In one embodiment the base and cover member each have substantially the same length and the cover member has a width that is substantially less than the width of the base member. Consequently, in the closed position the base and cover members are aligned lengthwise and in the open position the cover member is oriented at an angle with respect to the base member. Thus the consumer may easily identify whether the cap is in the open or closed position.

Two, the applicator element may be fixedly or detachably connected to the cover member. By having the applicator detachably connected to the cover member, the consumer may easily remove the applicator to either clean it or dispose of it after using it and then replace it with either the freshly cleaned, original applicator, or a new, fresh, applicator. The cover member may include a raised peripheral element surrounding a lower portion of the applicator element. The applicator element may have many forms. It may be resilient, for example, it may comprise a material that absorbs the fluid material flowing through the openings when the base and cover members are in the second position, for example, a sponge. It may be stiff, for example, bristles for scrubbing. It may be a dome with orifices through which a deodorant is dispensed. It may have an exposed flocked surface; it may have a slanted top surface. Additionally, the applicator may have different cross-sectional shapes: For example, it may be circular, oval, cross-shaped, rectangular, or triangular. The applicator does not have to be made of the same material throughout nor of the same density throughout; it may be made of multiple layers, for example there may be a layer of high density absorbent material close to the cover member and a layer of low density absorbent material on the end of the applicator furthest from the cover member.

Three, the container may serve as a handle that enables a consumer to squeeze it when the cap is in the second open position to apply the contents of the container onto a surface. The container may be made of a soft malleable plastic that allows for the easy compression thereof. The container may be blow molded for ease of manufacture. With a blow-molded container, a rigid insert at the dispensing end of the container is used to assist in mounting the cap to the container. Holding the container with one hand and with the cap in the open position, the consumer squeezes the container and uses the applicator to spread the applied contents over a surface. By having the applicator attached to the dispenser cap it becomes very convenient for the consumer to apply the contents stored within the container by squeezing the container to push some or all of its contents onto the applicator. The applicator may have a passageway that is interactive with the top enclosure for sealing purposes. This passageway may also assist applying the contents onto other portions of the applicator. It may be centrally located and extend longitudinally, and it may be axially aligned with the opening or openings in the base and cover members. Also, there may be a plurality of passageways in the applicator.

Four, the detachable enclosure includes an internal pin element that interacts with the cover member to provide a secondary seal when the enclosure is attached to the cap. For example, a tip of the pin element may extend into the opening in the cover member. Or, a tip of the pin element may abut and apply pressure to an end of a plug element extending into the opening in the cover member. Or, a tip of the pin element may extend into a passageway or orifice in the applicator. This secondary seal increases the quality of the overall seal of the dispenser cap when in the closed position, and is especially helpful in preventing leakage during shipment and displaying for sale. Additionally, the secondary seal prevents accidental spills should the consumer put the top enclosure on, but forget to return the dispenser cap to the first closed position. This pin element may extend away from an interior surface of an enclosure top wall in a substantially perpendicular direction towards an open bottom end of the enclosure. The open bottom end has a configuration that enables the enclosure to fit snugly onto the cap. The internal pin element is long enough that it can pass through the entire length of the passageway in the applicator to engage the cover member when attached to the cap. In one embodiment the enclosure has a number of pins that pass through and seal an equal number of openings in a dome shaped applicator that may be used, for example, to apply deodorant.

In one embodiment, the internal pin element has at an inner terminal end a hollow cylindrical wall defining a cavity. The cylindrical wall fits tightly within a similarly cylindrical shaped central indentation or groove in the cover member that substantially surrounds the opening in the cover member. Thus, when the cover and base members are in the closed position and the top enclosure in place on the cap, a tight seal is provided and the top enclosure is held securely in place on the dispenser cap. In another embodiment, a raised wall substantially surrounding the opening in the cover member provides an open space and the internal pin element has an inner terminal end that fits snugly into this open space when the base and cover members are in the closed position. The enclosure may include a closed top end and an inward projecting retainer element at the open bottom end, enabling the enclosure to be detachably connected to an edge of the cover member or the base member. The enclosure may have an external abrasive surface, for example at its closed top end, and the enclosure may include at least one vent opening.

Five, the base member may include a plug element that seals the opening in the cover member. When the dispenser cap is in the first, closed position, the plug element may fit snugly within the opening in the cover member or it may press against a bottom tip of the internal pin element of the top enclosure, thereby sealing the fluid material inside the container and not allowing any seepage. When the consumer rotates the cover member in one direction relative to the base member, the plug element disengages and separates from the cover member, thereby breaking the seal and allowing the contents of the container to be dispensed.

Six, the dispenser cap may include at least one stop element that inhibits rotational movement of the cover member relative to the base member. Upon opening the cap, the stop element may indicate that the cap is in the completely open position when the stop element is reached. For example, the consumer feels that continued rotation is impeded. The stop element may be such that the consumer can continue to twist the cover member relative to the base member, moving past the stop element by applying an additional amount of torsional force, thereby detaching the cover member from the base member. When reattaching the cover member, again an additional amount of torsional force is needed to overcome the impediment of the stop element. As long as the cover member is between the first and second positions the cover member turns freely. A clicker member may also be a component of the cap. It provides an audible signal when the cover member is moved into the completely closed position and also upon moving from the completely closed into an open position.

Seven, the dispenser may include multiple seals. For example, mating annular elements may be located on different portions of the base and cover member, or mating annular elements may be located on different portions of the pin element and the base member or the pin element and the cover member. For example, the pin element may include at least one annular element that is in a mating relationship with an annular element on a plug element on the base member that fits in the opening when the cover member is in the closed position. The cover and base members also may each include at least one annular element, and these annular elements are aligned to mate with each other when the cover member is in the closed position.

Eight, the outside surface of the container may include indicia that identifies the contents therein. Some of the possible indicia include, but are not limited to, a numerical code number representing the particular paint color, a plain descriptive name of the color of paint, a machine readable pattern, such as a barcode, representing the color the paint. The plurality of indicia makes it easier for the consumer to communicate the desired paint color, and for the retailer to be able to determine the color inside the container for future sales.

These features are not listed in any rank order nor is this list intended to be exhaustive.

This invention also includes an improved paint selection and merchandising method where the consumer uses a dispenser holding only a small sample of the color paint they anticipate will provide the desired color with the expected gloss level when applied to the object being painted. Consequently, the consumer only buys a small quantity of paint. Moreover, the dispenser may be used for small touch up work or for painting small objects. Additionally, when using the dispenser of this invention, the consumer does not need to purchase a paintbrush. One embodiment of the method of this invention comprises:

(a) providing at a sales source a plurality of compact paint dispensers from which a consumer selects one or more, each individual dispenser containing a paint of a predetermined color and including a paint applicator having a manually actuated open and closure mechanism to enable a consumer to release selectively paint therefrom, (b) using one or more paint dispensers obtained from the sales source, applying as a specimen of paint from a selected dispenser to a test surface to enable a consumer to identify a desired color of paint to be used to paint the surface with a quantity of paint substantially greater than that contained within an individual dispenser or dispensers being used to apply paint to the test surface, and (c) subsequent to step (b), ordering a larger quantity of paint and identifying the color of paint being ordered.

The attached applicator can be used like a brush to spread the paint over the surface, typically at a location remote from the sales source. Once the paint has been applied and given enough time to dry the consumer then selects the desired color and relates that information to the store where he or she can then purchase the larger quantities of the desired paint color, typically at least one quart or more. Typically, the individual dispensers may contain no more than about 8 ounces of a particular color of a paint and may include indicia thereon that identifies the color of the paint therein. The indicia may be machine-readable. In that case, an order is placed by returning the dispenser to the sales source to enable the indicia to be machine read at this source. The indicia may be imprinted on the dispenser in a form understandable to a human consumer to enable a human consumer to place an order with the sales source, for example by telephone or over the internet, using the human readable indicia to identify the color of paint being ordered. A label may contain the name or identification number of the color selected or a bar code or all of these indicia identifying the paint color in the container. By putting this information on the container the consumer does not have to remember what paint color was in what container, and if they like the color, it is very simple and error proof for an employee at the sales source to mix a larger quantity of the same color paint.

The invention also includes a method of applying a fluid skin care product to the skin of a person. A dispenser is used having a container holding a fluid skin care product, a twist-open cap on the container, an applicator attached to the cap, a passageway through which the skin care product flows upon twisting the cap open, and a detachable enclosure mounted to the cap that covers the applicator and at least partially blocks the passageway. In accordance with this method, the enclosure is removed, the cap is twisted open, and the applicator is used to apply the skin care product to the skin of the person.

DESCRIPTION OF THE DRAWING

Some embodiments of this invention, illustrating all its features, will now be discussed in detail. These embodiments depict the novel and non-obvious dispenser and method of this invention as shown in the accompanying drawing, which is for illustrative purposes only. This drawing includes the following figures (Figs.), with like numerals indicating like parts:

FIG. 6A is a plan view of an underside of a dispenser cap's cover member taken along line 6A-6A of FIG. 6C.

FIG. 6B is a cross-sectional view of the third embodiment of the dispenser of this invention in the closed position and with the top enclosure secured in place.

FIG. 6C is a cross-sectional view similar to that of FIG. 6B showing a detached cover member.

FIG. 6D is a fragmentary cross-sectional view taken along line 6D-6D of FIG. 6A.

FIGS. 7 through 7I show a fourth embodiment of the dispenser of this invention, where:

FIG. 7 is an exploded perspective of the fourth embodiment of the dispenser of this invention.

FIG. 7A is a cross-sectional view of the embodiment shown in FIG. 7 with a top enclosure attached.

FIG. 7C is a plan view of a topside of a dispenser cap's base member taken along line 7C-7C of FIG. 7B.

FIG. 7D is an enlarged, fragmentary cross-sectional view of the area enclosed by a circular line 7D of FIG. 7A showing the interlocking of the top enclosure to the dispenser cap.

FIG. 7E is an enlarged, fragmentary cross-sectional view of the area enclosed by a circular line 7E of FIG. 7A showing a sealing between the cover member and the base member.

FIG. 7F is an enlarged, fragmentary cross-sectional view of the area enclosed by a circular line 7F of FIG. 7A showing the enclosure pin inserted into the cover member opening to further seal the dispenser.

FIG. 7G is an enlarged, fragmentary cross-sectional view of the area enclosed by a circular line 7G of FIG. 7B showing a stop mechanism.

FIG. 7H is an enlarged, fragmentary cross-sectional view of the dispenser shown in FIG. 7B with the top enclosure removed and the cap opened to allow fluid material to be dispensed.

FIG. 7I is an enlarged, fragmentary cross-sectional view of the area enclosed by a circular line 7I of FIG. 7A showing the matched pair of threads of the cover member and base member.

FIGS. 17A through 17D illustrate the paint merchandising method of this invention, where:

FIG. 17A is a depiction of a consumer purchasing from a salesperson one or more of the dispensers of this invention containing paint.

FIG. 17B is a depiction of a consumer applying the paint to the surface of an object using a dispenser of this invention.

FIG. 17C is a depiction of a consumer calling a salesperson to communicate which color the consumer has determined works the best on the selected surface and ordering additional quantities of the desired paint color.

FIG. 17D is a depiction of a bar code on a dispenser of this invention being scanned facilitating ordering a larger quantity of the desired color of paint.

DETAILED DESCRIPTION OF SOME EMBODIMENTS OF THIS INVENTION

General

Figure 7:
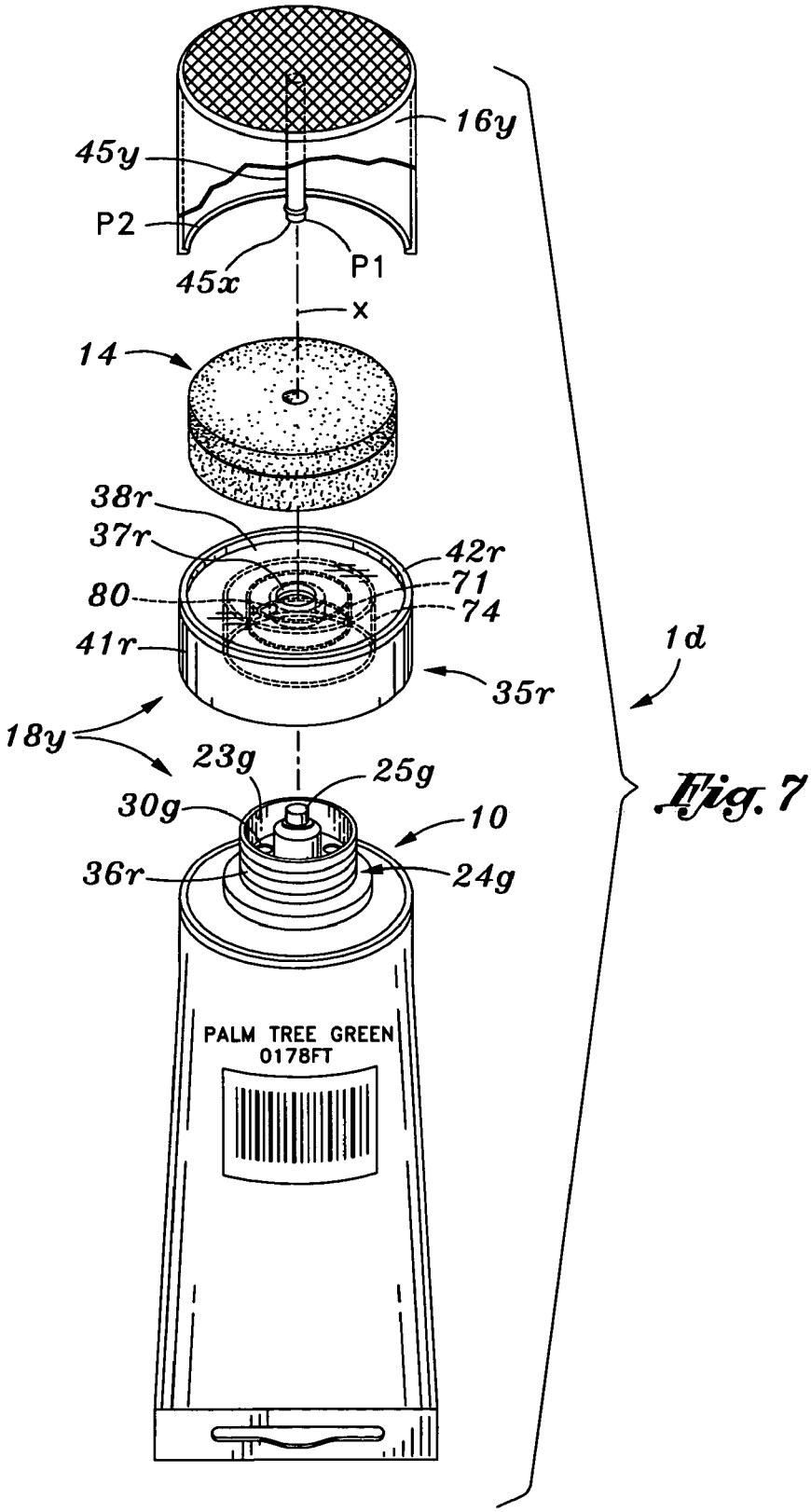
Figure 8:
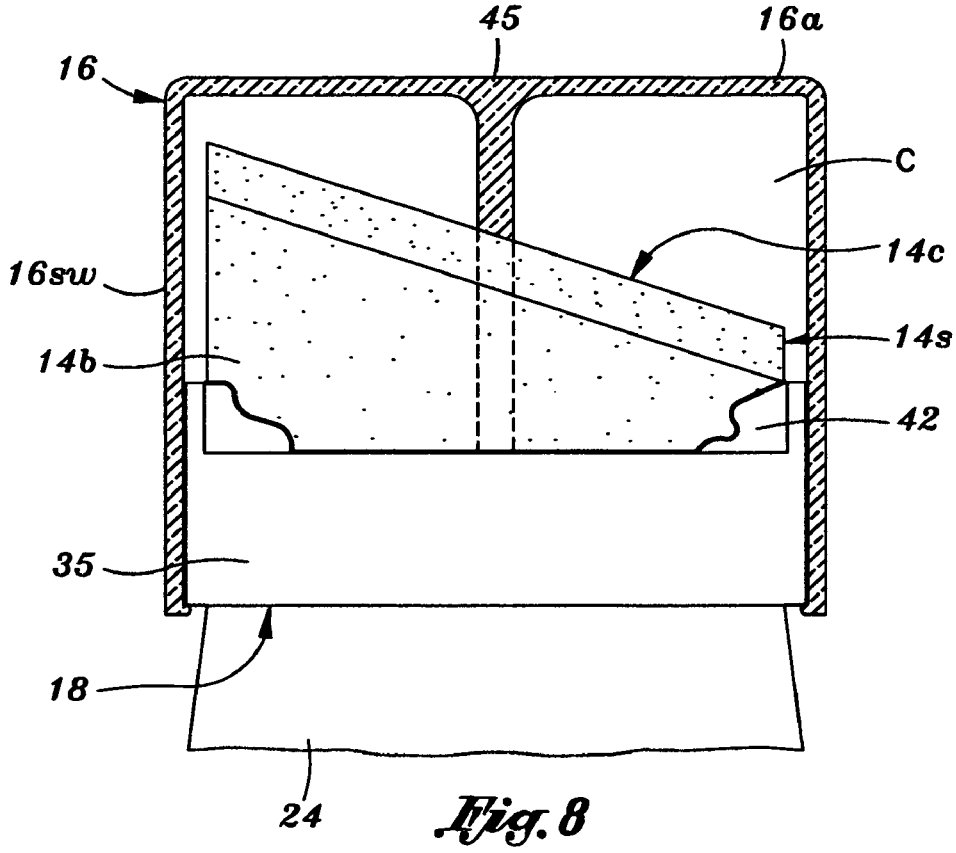
FIG. 8 is an enlarged, fragmentary view, partially in cross-section, of an alternate embodiment of the dispenser of this invention employing an applicator having a slanted top surface.
Figure 9:
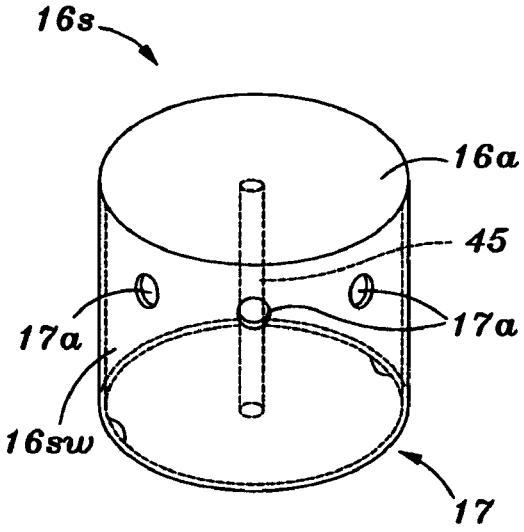
FIG. 9 is a perspective view of an alternate embodiment of an enclosure having a plurality of ventilation holes used in the dispenser of this invention.
Figure 13A:
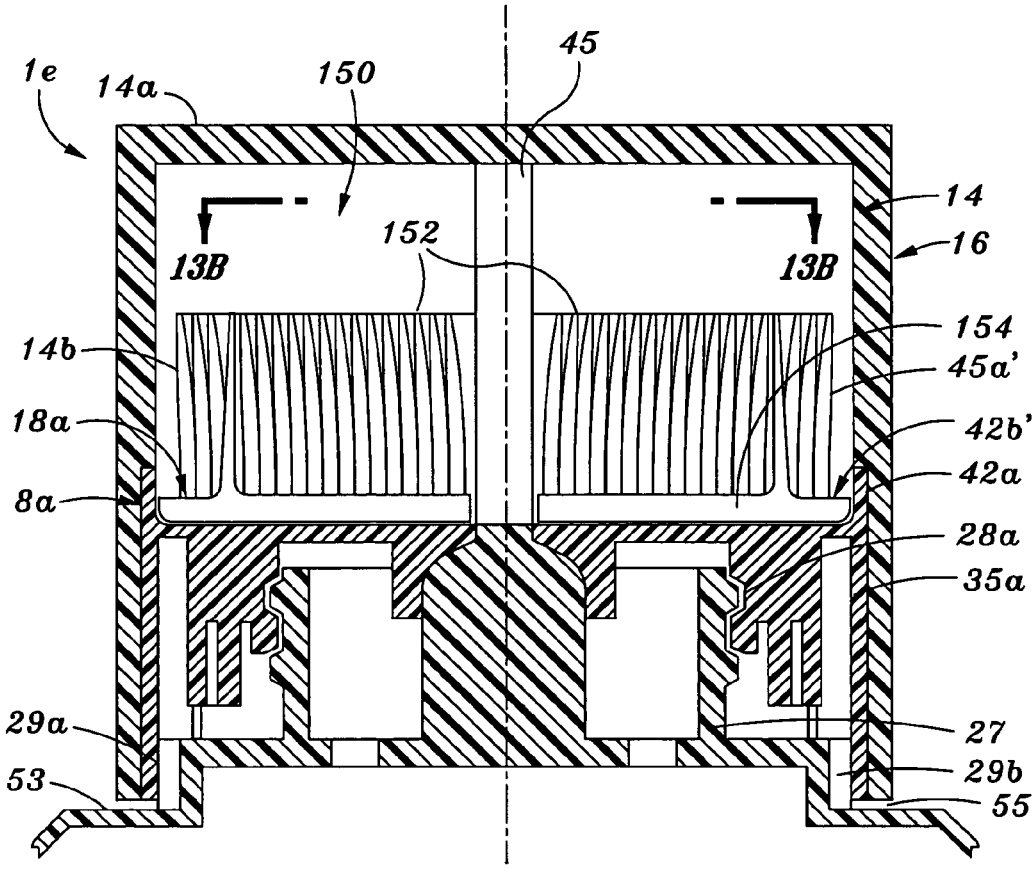
FIG. 13A is a cross-sectional view of another embodiment of this invention showing an applicator employing bristles for scrubbing a surface.
Figure 13B:
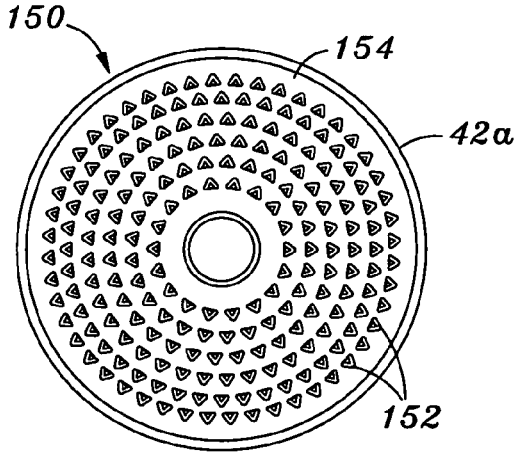
FIG. 13B is a plan view taken along line 13B-13B of FIG. 13A.
Figure 13C:
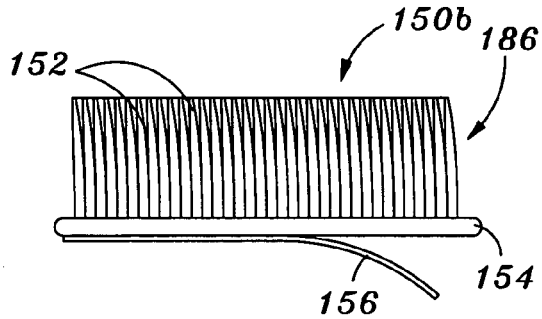
FIG. 13C is a side view of an adhesive backed, replaceable bristle applicator.
Figure 14A:
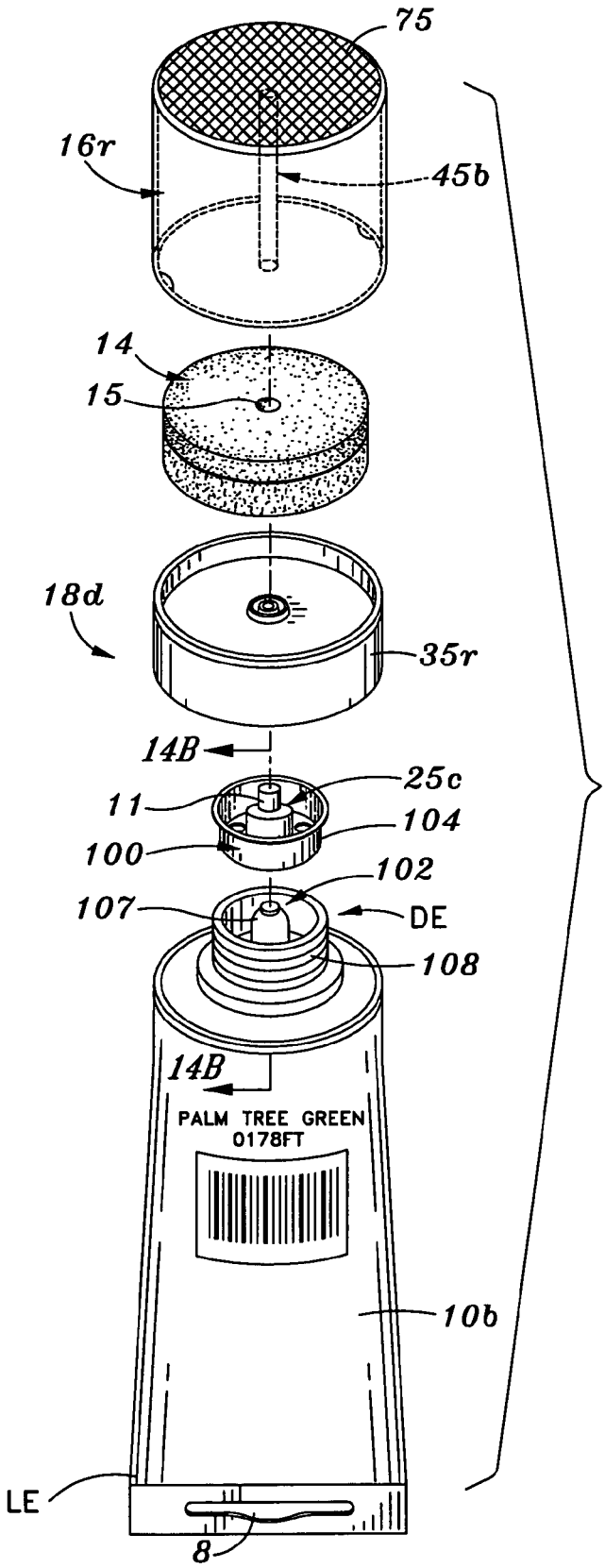
FIG. 14A is a perspective view of one embodiment of the dispenser of this invention where the container is made using the blow mold process.
Figure 14B:
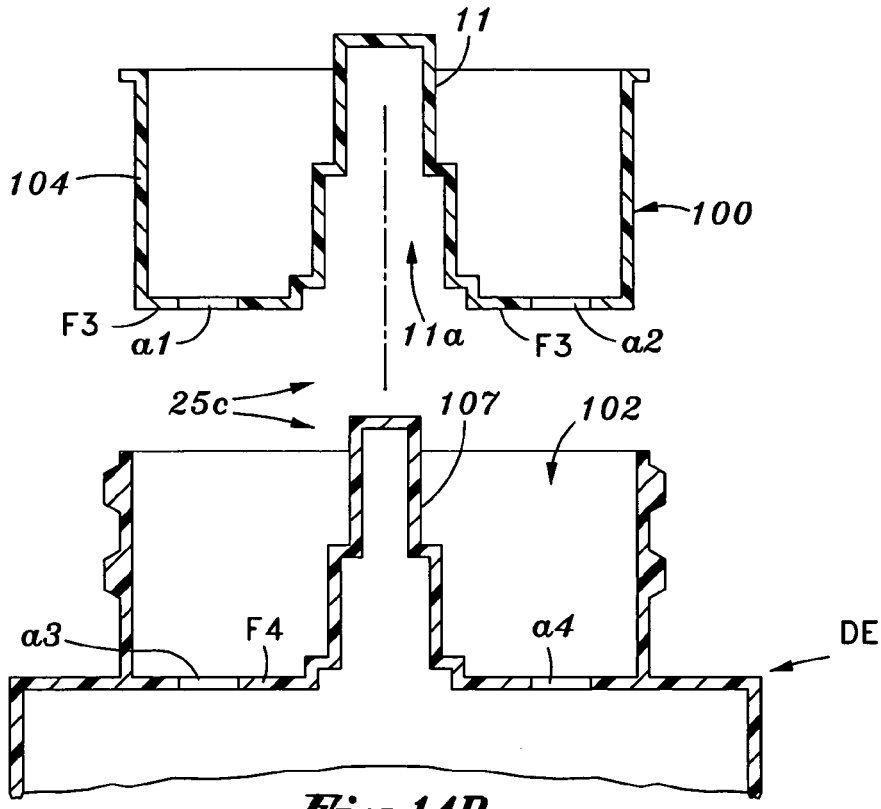
FIG. 14B is cross-sectional view taken along line 14B-14B of FIG. 14A.
Figure 14C:
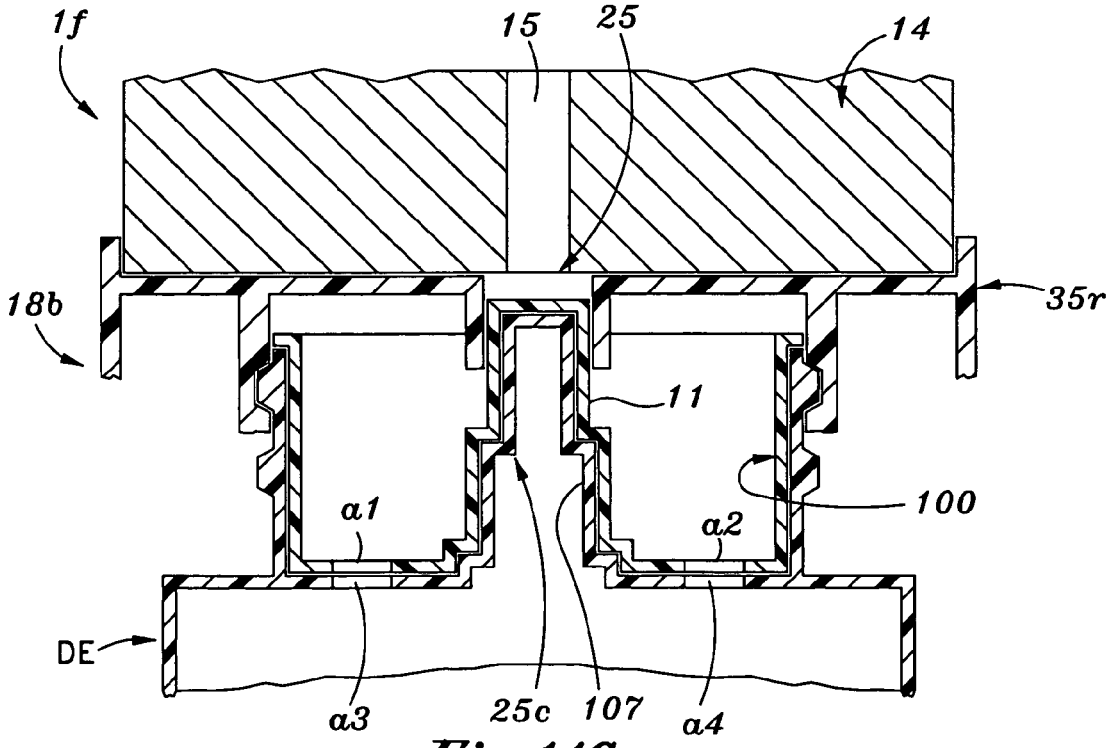
FIG. 14C is a cross-sectional view of the dispenser of this invention shown in FIGS. 14A and 14B with its cover and base member components all attached.
Figure 15A:
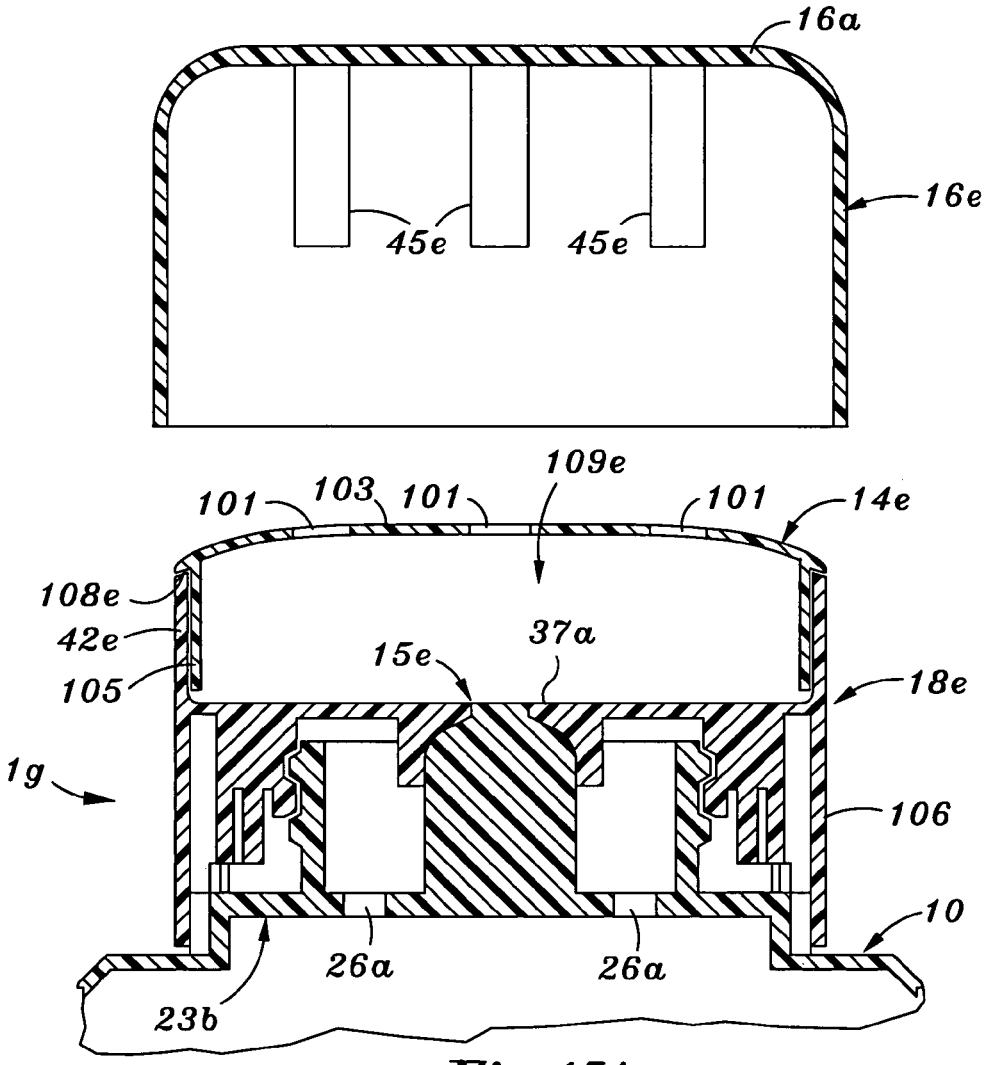
FIG. 15A is a cross-sectional view of an embodiment of this invention employing an applicator with a smooth, porous surface that is suited to dispense a deodorant or other liquid.
Figure 15B:
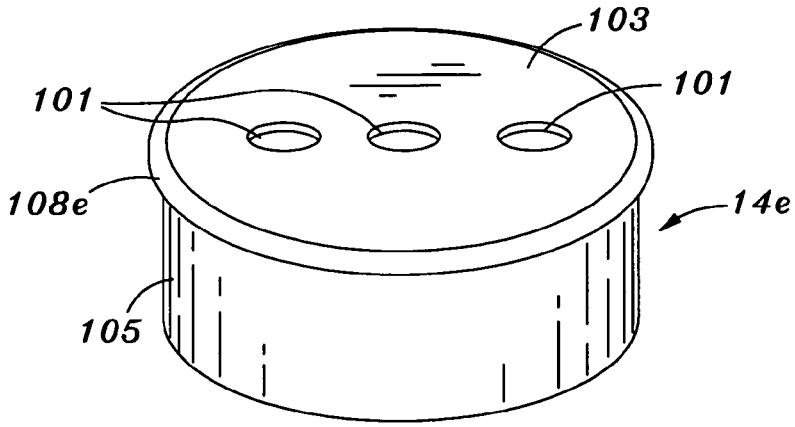
FIG. 15B is a perspective view of the applicator used in the embodiment shown in FIG. 15A.
Figure 15C:
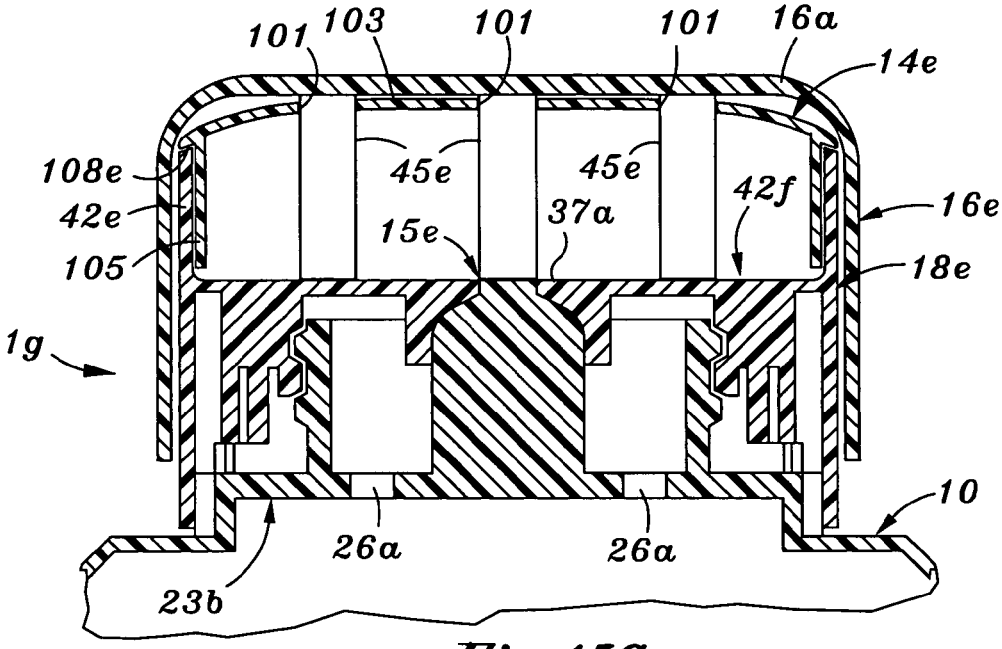
FIG. 15C a cross-sectional view similar to that of FIG. 15A showing pins of a top enclosure inserted into orifices in the applicator.
Figure 16:
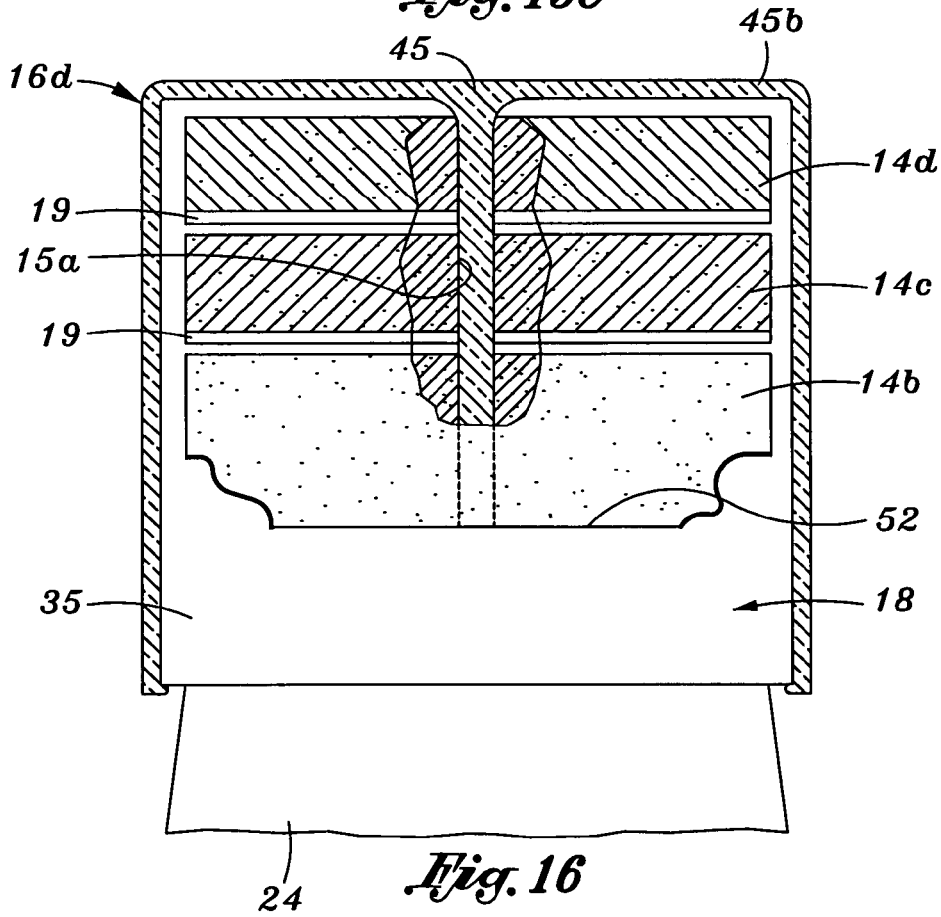
FIG. 16 is a side view with sections broken away of an embodiment of this invention showing a top enclosure holding extra, replaceable applicators.

FIGS. 1 through 4 depict one embodiment of the dispenser of this invention, the dispenser 1*a*; FIG. 4A depicts another embodiment of the dispenser of this invention, the dispenser 1*b*; FIGS. 6A through 6D depict a conventional cap modified to form one more embodiment of the dispenser of this invention, the dispenser 1*c*; FIGS. 7 through 7I depict an embodiment employing a dispenser cap with multiple seal points, the dispenser 1*d*; FIG. 8 illustrates an embodiment employing an applicator having a slanted top surface; FIG. 9 shows an embodiment employing a top enclosure with a plurality of ventilation holes; FIGS. 10 through 12B depict alternate embodiments employing dispenser caps of different shapes; FIGS. 13A through 13C illustrate an embodiment using an applicator with bristles, the dispenser 1*e*; FIGS. 14A through 14C depict a blow molded container with a hard plastic insert at its dispensing end, the dispenser If; FIGS. 15A through 15C depict an embodiment having a rigid, dome shaped applicator adapted to be used to apply deodorant to a human's underarm, the dispenser 1*g*; FIG. 16 illustrates an embodiment where a top enclosure holds extra, replaceable applicators; and FIGS. 17A through 17D depict the merchandising of paint of different colors in accordance with the method of this invention.

The different embodiments of the dispenser of this invention include (i) a container 10 holding a fluid material, typically a liquid or gel, (ii) a dispenser cap (different types may be employed as discussed subsequently) operatively connected to the container 10, (iii) an applicator (different types may be employed as discussed subsequently) operatively connected to the dispenser cap, and (iv) a manually removable top enclosure (different types may be employed as discussed subsequently) covering the applicator and having an internal, a longitudinally extending enclosure pin or pins that engage the applicator to provide an additional seal. The dispenser cap may be detachably connected to the container 10 or it may be integral with the container 10 and not be detached without damaging the container. The container 10 may be made of a flexible or malleable material such as a thin plastic, enabling the container to be squeezed to expel the contents of the container. The container 10 may be made using conventional techniques, and may, for example, be extruded. Alternately, it may be blow molded as depicted in FIGS. 14A through 14C. The dispenser cap and top enclosure may each be made of a rigid material such as a hard plastic and formed by a conventional molding process.

FIGS. 1 Through 5, 8, and 9

Referring to FIGS. 1 through 4, the dispenser 1*a* includes the container 10, a substantially cylindrically shaped dispenser cap 18, attached to an upper end 10*a* of the container 10, and a top enclosure 16. The dispenser cap 18 comprises two main components: a substantially cylindrical shaped base member 24 and a substantially cylindrical shaped cover member 35. Attached to the cover member 35 is an applicator 14. The applicator 14 has an elongated opening forming a passageway 15 that longitudinally extends along a central reference line, axis X. Typically, the base member 24 and cover member 35 are molded from a plastic such as, for example, polyethylene. In this embodiment the base member 24 is integral with the container 10 as best shown depicted in FIGS. 3 and 3A.

Figure 3A:
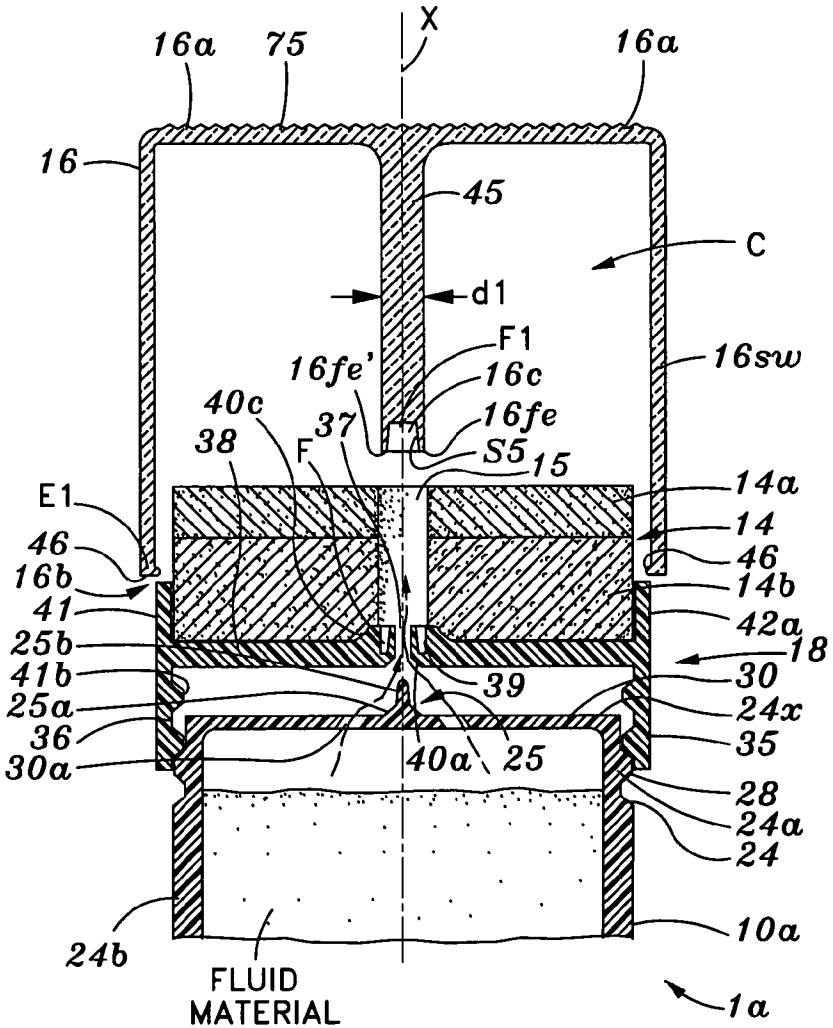
FIG. 3A is a fragmentary cross-sectional view similar to FIG. 3 with the dispenser cap in an open position and the top enclosure removed and elevated above the dispenser cap.
Figure 3:
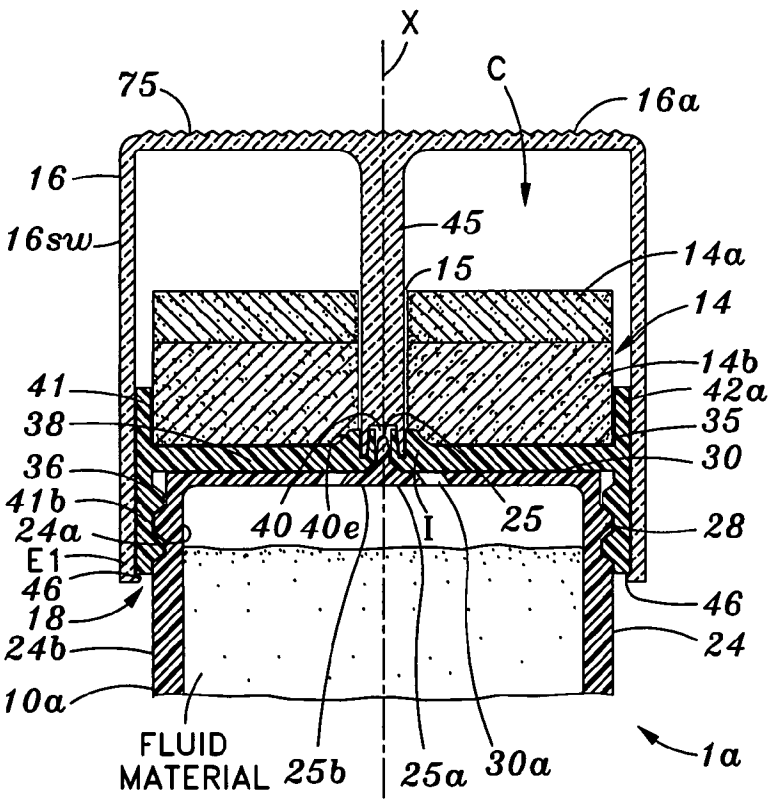
FIG. 3 is a fragmentary cross-sectional view taken along line 3-3 of FIG. 1.

FIG. 3 shows the dispenser cap 18 in a closed position and FIG. 3A shows the dispenser cap 18 in an open position with the top enclosure 16 removed. The cover member 35 overlies the base member 24 and both these members are along the axis X and mounted to rotate relative to each other. Specifically, the base member 24 and the cover member 35 include a matching set of threads 28 and 36, respectively. This thread arrangement allows the cover member 35 to be twisted manually with respect to the base member 24, rotating about the axis X. This rotation raises or lowers the cover member 35 with respect to the base member 24 to move back and forth between the closed position and open position.

The base member 24 includes a central base plug 25 along the axis X. The base plug 25 is a short, substantially conical protrusion that extends outward from the base member 24, substantially perpendicular to an exterior surface 24*x* (FIG. 3A) of a top wall 30 of the base member 24. From where the base plug 25 joins the top wall 30, the base plug tapers upward and inward to create a base plug that is wider at its lower portion 25*a* than the tip 25*b* of the base plug 25. Adjacent to the base plug 25 are one or more holes 30*a* in the top wall30 that, when the dispenser cap 18 is in an open position (FIG. 3A), allows fluid material in the container 10 to escape, for example, upon squeezing the container. In this embodiment, the base member's external threads 28 are located on the outer wall 24*a* of the base member 24, and this outer wall 24*a* is integral with and forms a wall of the container 10. These walls transition into each other in such a manner that there is no clear delineation between where the base member 24 stops and a container wall 10*a* begins.

The cover member 35 includes a substantially circular top wall 38 and a cylindrical cover sidewall 41 along an outer edge of the top wall 38. The cover sidewall 41 is oriented substantially perpendicular to the top wall 38 and extends above and below the top wall 38, forming the perimeter of the cover member 35. The cover sidewall 41 has a smooth exterior surface and is integral with top wall 38. The internal surface of the portion 41*b* of the cover sidewall 41 that extends below the cover top wall 38 includes the threads 36. The matching threads 36 and 28 operatively connect the cover member 35 and the base member 24 in a manner that allows the cover member 35 to move only in a circular twisting manner, clockwise or counterclockwise. The portion of the cover sidewall 41 that extends above the top wall 38 forms a cover lip 42*a* to create a substantially cylindrical receptacle portion 42*b* (FIG. 2) in which the applicator 14 is seated. The diameter of the receptacle portion 42*b* is substantially equal to the diameter of the applicator 14, so the lower portion of the applicator 14 fits snugly within this receptacle portion. The lip 42*a* extends above the cover top wall 38 to assist in holding the applicator 14 in place within the receptacle portion 42*b*, thus helping to keep the applicator 14 securely attached to the cover top wall 38 when lateral forces are applied thereto during use.

In the embodiment shown in FIGS. 1 through 4, the applicator 14 has a cylindrical shape and is made of two different resilient materials, for example, a low-density sponge forming the bottom layer 14*b* and a high-density sponge forming the top layer 14*a*. In the embodiment shown in FIG. 5, an applicator 14*f* is used in which the inner material is a soft sponge-like material and its outer surface S6 comprises of a multitude of small diameter, short fibers 13*c*; this outer surface S6 is also known as a flocked surface. In the embodiment shown in FIG. 8, an applicator 14*s*, similar to the applicator 14, is illustrated, but this applicator 14*s* has a slanted top surface 14*c*.

The applicator may be fixedly attached to the cover member 35, for example as depicted in FIGS. 1 through 4, or, as depicted in FIG. 16, it may be mounted so that it may be removed, discarded, and replaced with a fresh applicator. In the embodiment illustrated in FIGS. 1 through 4, the applicator 14 is glued to the top outer surface S2 of the cover top wall 38 to fixedly attach it to the top outer surface S2 of the cover top wall 38. The lower portion of the applicator 14 fills substantially the entire receptacle portion 42*b* in the cover top wall 38. The longitudinal passageway 15 of the applicator 14 has a diameter that is equal to, or slightly greater than the diameter of the external surface of the enclosure pin 45. With the top enclosure 16 covering the dispenser cap 18 and the dispenser cap 18 closed (FIG. 3), the pin 45 passes through the applicator passageway 15 and mates with an annular channel 39 in the cover member 35 to aid in sealing the container 10 as discussed subsequently in greater detail. When the dispenser cap 18 is opened (FIG. 3A) and the top enclosure 16 detached from the dispenser cap 18, the pin 45 is withdrawn from the passageway 15, enabling the consumer to dispense the fluid material from the container 10.

Figure 4:
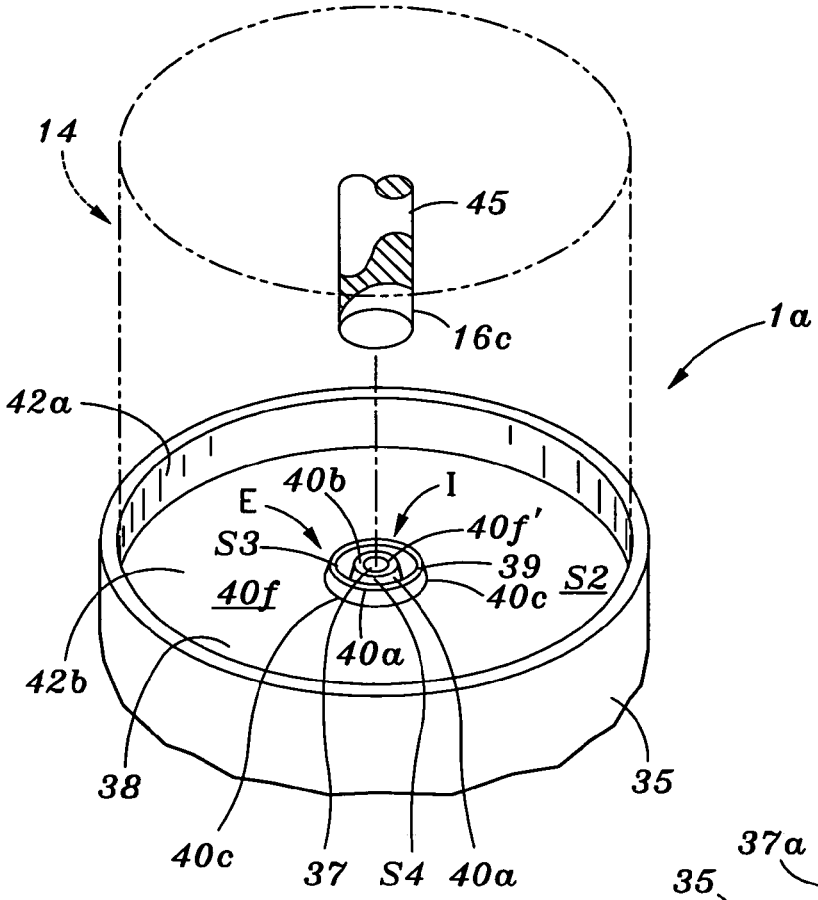
FIG. 4 is a fragmentary perspective view, with sections broken away, of the exterior surface of the top wall of the cover member of dispenser cap shown in FIG. 1, with the applicator shown in phantom lines and the tip of an internal pin in the top enclosure elevated above the center of the cover member.
Figure 4A:
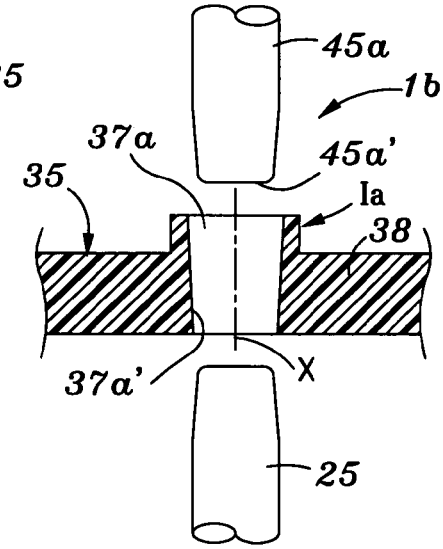
FIG. 4A is an enlarged fragmentary cross-sectional view of an alternate embodiment of the cover member of the dispenser cap employed in this invention with an alternate embodiment of the internal pin, elevated above the center of the cover member.
Figure 5:
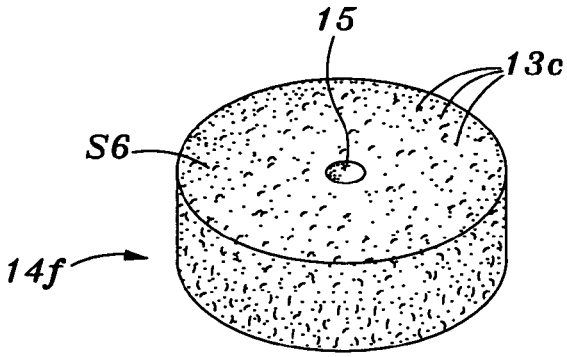
FIG. 5 is a perspective view of an applicator having a flocked surface.

As best depicted in FIGS. 3A and 4, the top wall 38 is mostly of uniform thickness except for a raised central island I on the exterior surface S2 of this top wall 38. An opening 37 (FIG. 3A) in this island I extends through the center of the cover top wall 38 and lies along the axis X. The opening 37 is sized and shaped such that the base plug 25 fits snugly within it, leaving no gaps when the dispenser cap 18 is closed (FIG. 3). Specifically, the diameter of the cover opening 37 initially remains constant as it projects inward towards the base member 24 but then increases, expanding outward to accommodate the tapered lower portion 25*a* of the base plug 25 upon closure of the dispenser cap 18 (FIG. 3). Additionally the annular channel 39 is in the island I and is concentric with the opening 37.

As best shown in FIGS. 4 and 3A, the combination of the opening 37 and concentric channel 39 forms in the island I a pair of concentric rings: an outer ring 40*a* and inner ring 40*b*. The exterior surface of the outer ring 40*a* tapers outward away from the opening 37 until its lower outer edge 40*c* is flush with the surface S2 of cover top wall 38. The ring 40*a* extends upward from this edge 40*c* to terminate in a substantially flat surface 40*f*. The inner ring 40*b* also terminates in a substantially a flat surface 40*f'*. The flat surfaces 40*f* and 40*f'* are substantially coplanar and substantially parallel to the surface S2 of the cover top wall 38. The interior surface S3 of the outer ring 40*a* is substantially perpendicular to the flat surface 40*f* and the exterior surface S4 of the inner ring 40*b* is tapered slightly outward toward the surface S3 of the outer ring 40*a* such that the entrance E to the cover channel 39 is slightly wider than its floor F. This creates a channel cross-sectional configuration which mates with a uniquely shaped free end 16*fe* (FIG. 3A) of the enclosure pin 45 when the top enclosure 16 is attached as shown in FIGS. 1 and 3.

The top enclosure may be, for example, a solid top enclosure 16 (FIG. 2) or include a plurality of ventilation holes 17*a* (FIG. 9). As best shown in FIGS. 2, 3 and 3A, the top enclosure 16 is a substantially cylindrical structure having a circular top wall 16*a* closing one end of the top enclosure 16. An annular sidewall 16*sw* extends outward from the top wall 16*a* substantially perpendicular thereto, terminating in an open-end 16*b* opposite the top wall. Typically, the top enclosure 16 is rigid, for example being molded from a hard plastic; and it may be opaque or, to enable a consumer to see the applicator 14, it may be translucent or transparent. The enclosure pin 45 discussed above is integral with the top wall 16*a* and extends into an internal cavity C in the top enclosure 16 substantially perpendicular to the top wall 16*a* along a longitudinal center line L (FIG. 2), which is coextensive with the axis X when the top enclosure 16 is attached to the dispenser cap 18 as shown in FIG. 1. There is a pair of opposed prongs 46 at a bottom edge E1 of the open-end 16*b*. As shown in FIG. 3, the prongs 46 protrude inward a short distance toward the centerline L just enough to secure the top enclosure 16 in place over the dispenser cap 18. The prongs 46 hold the top enclosure 16 snugly in place, but are sufficiently flexible to allow the consumer to remove the top enclosure by applying an adequate amount of force. Alternately, instead of a plurality of individual discrete prongs 46, the prong may be an annular ring that projects, approximately the same length as the prongs 46, toward the center of the top enclosure 16 from the inside surface of the top enclosure 16. The annular ring is identical in function to the prongs 46

Figure 1:
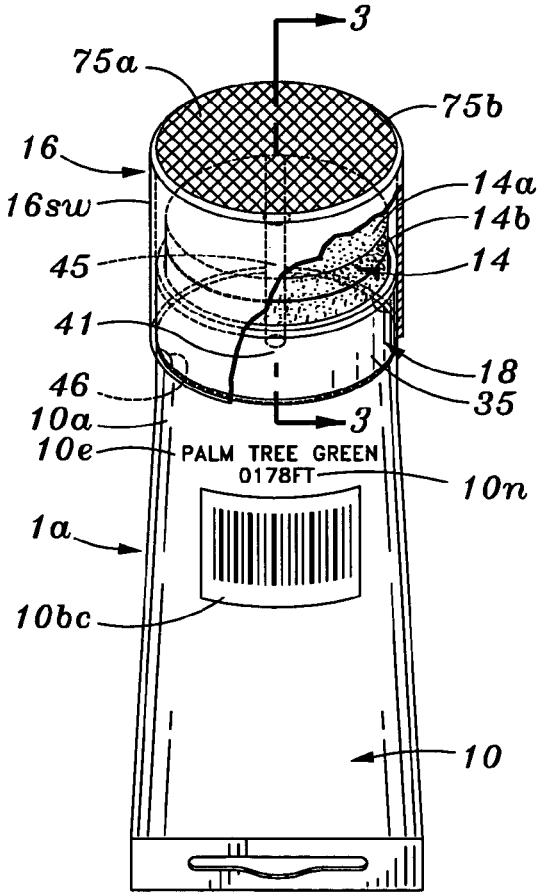
FIG. 1 is a perspective view, with sections broken away, of one embodiment of the dispenser of this invention with a dispenser cap attached to a container and the cap in the closed position and a top enclosure in place.
Figure 2:
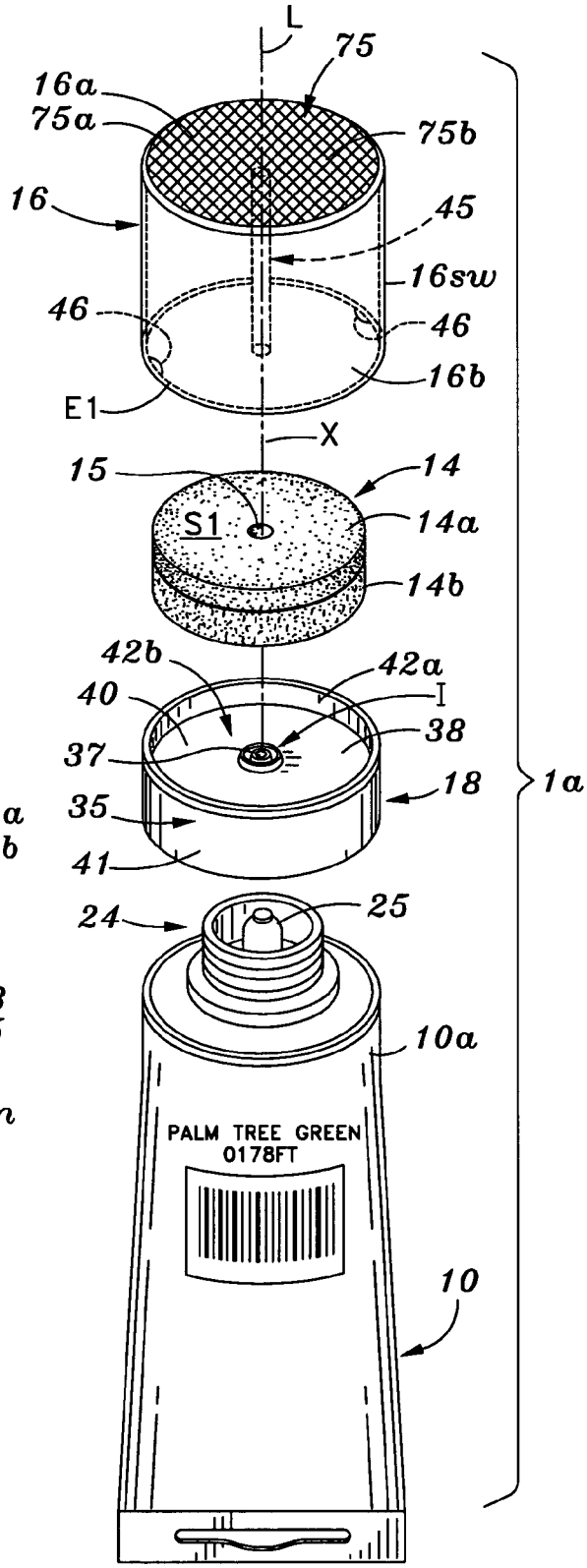
FIG. 2 is an exploded perspective view of the dispenser shown in FIG. 1.

As depicted in FIG. 1, the exterior of the enclosure top wall 16*a* may have an abrasive surface 75 that allows the consumer to smooth potentially rough areas on the surface they wish to cover with the fluid material. The abrasive surface 75 may be created by bonding with adhesive an abrasive material such as sandpaper to the exterior of the top wall 16*a*, or it may be integral therewith, for example formed during molding of the top enclosure 16. The abrasive surface 75 depicted in FIG. 1 is one that is integral with the outer surface of the top wall 16*a* and formed during molding. This abrasive surface 75 comprises one set 75*a* (FIG. 1) of multiple parallel shallow grooves that are at a right angle to another set 75*b* of multiple parallel shallow groves. This crisscrossing of the two sets 75*a* and 75*b* of parallel groves creates a plurality of shallow pockets, thus creating an abrasive surface 75. In an alternate embodiment shown in FIG. 9, a top enclosure 17 does not have an abrasive surface but includes a plurality of ventilation holes 17*a* in the sidewall 16*sw* to allow air to access and dry the applicator 14. These ventilation holes 17*a* do not adversely affect sealing of the container 10 as discussed subsequently.

In the embodiment illustrated in FIGS. 1 through 4, the enclosure pin 45 is an elongated cylindrical member having a free end 16*fe* (FIG. 3B) shaped to fit snugly within the channel 39 of the cover member 35. More specifically, as best shown in FIGS. 3A and 3B, this free end 16*fe* terminates in a flat surface edge 16*fe'* and includes a cavity 16*c* having an inwardly tapering internal surface S5 and a depth that essentially equals the depth of the channel 39. The cavity 16*c* is formed by an annular wall having the internal surface S5 and terminating at a ceiling F1. The enclosure pin 45 has an outside diameter dl that is equal to, or just slightly less than, the diameter of the annular interior surface S3 of the outer ring 40*a*. The depth of the cavity 16*c* is sufficient to allow the free end 16*fe* to fit all the way to the floor F of the channel 39 when the top enclosure 16 is attached to the cap 18. The internal surface S5 progressively decreases the diameter of the hollow cavity 16*c* as it extends along the length of the enclosure pin 45, substantially matching the configuration of the channel 39 and being equal to, or just slightly greater than, the changing width of the channel 39. In other words, the cross-sectional configuration of the free end 16*fe* is complementary to the cross-sectional configuration of the channel 39. Thus, upon attaching the top enclosure 16 to the cap 18, there is a male-female mating connection, with the flat surface 40*f'* of the inner ring 40*b* abutting the ceiling F1 of the cavity 16*c* and flat surface edge 16*fe'* abutting the floor F of the channel 39 and the annular wall fitting snugly within the channel.

In an alternate embodiment shown in FIG. 4A, the top enclosure 16 employs a solid enclosure pin 45*a* and the cover member 35 employs a central island Ia with a single, substantially cylindrical opening 37*a* extending through the cover member along the axis X. When the top enclosure 16 is attached to the dispenser cap 18, the end 45*a'* of the pin 45*a* is pushed into the opening 37*a*. The end 45*a'* of the pin 45*a* and the internal side 37*a'* of the opening 37*a* may be tapered slightly. In both embodiments shown in FIGS. 3A and 4A, the pins 45 and 45*a* are sufficiently long to penetrate a sufficient distance into their respective opening 37 and 37*a* to seal, at least partially, these openings. Also in both these embodiments, the annular sidewall 16*sw* is longer than the pins 45 and 45*a*, so that, when the top enclosure 16 is attached to the dispenser cap 18 as shown in FIG. 3, the prongs 46 grip the dispenser cap 18, for example, along a bottom edge of the portion 41*b* of the cover sidewall 41. Alternately, these prongs 46 may grip the base member 24 or another part of the container 10 when the top enclosure 16 is attached to the dispenser cap 18, or an annular projection and recess may be used as discussed subsequently in connection with FIGS. 7A through 7 I.

When the fluid material is to be dispensed from the container 10, the top enclosure 16 is detached and the cover member 35 is twisted to break the seal between the cover member 35 and the base member 24 (FIG. 3A). Thus, upon squeezing the container 10, the fluid material flows through the holes 30*a* and then through the opening 37 and finally into the passageway 15 and the applicator 14. The sponge applicator 14 absorbs this material. To release this fluid material from the sponge applicator 14, the applicator is compressed inward toward the cover top wall 38 by pressing its exterior top surface S1 against an object's surface, releasing the fluid material retained in the pores of the applicator 14 and applying it to the object's surface. The height of the cover lip 42*a* is such that, when the applicator 14 is compressed, this lip does not touch an object's surface. In other words, the length of the applicator is substantially greater than the height of the cover lip 42*a*, so that a top surface S1 of a compressed applicator is still above the cover lip 42*a*.

After dispensing the fluid material from the container 10, the cover member 35 is rotated counter-clockwise as viewed in FIGS. 1 and 3 as far as it can go, lowering the cover member 35 as low as it can go, thus putting the dispenser cap 18 in the closed position sealing the container 10 by the mating of the matching male base plug 25 and female cover opening 37. The sealing of container 10 is further reinforced, when the top enclosure 16 is snapped into place over the dispenser cap 18. The reinforcement occurs by mating the cover member channel 39 with the free end 16*fe* of the enclosure pin 45.

FIGS. 6A Through 6D

Figure 6A:
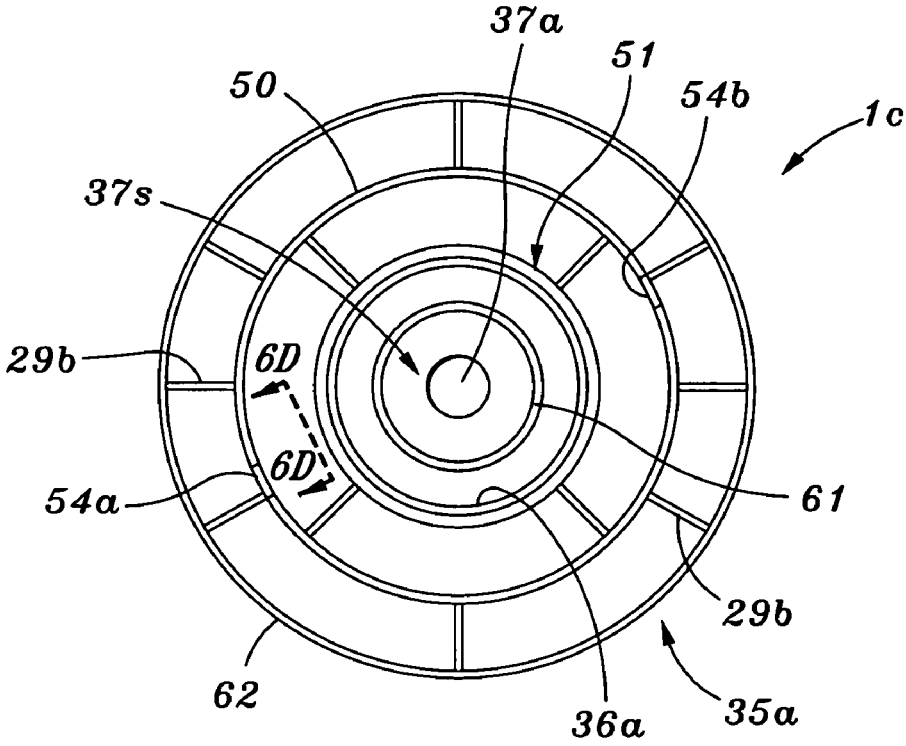
FIGS. 6A through 6D show a third embodiment of the dispenser of this invention employing a modified conventional dispenser cap, where
Figure 6D:
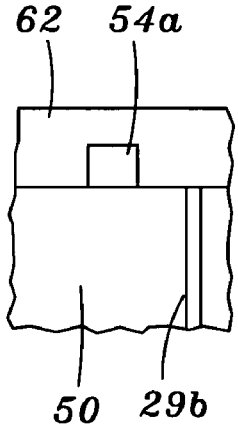
Figure 6C:
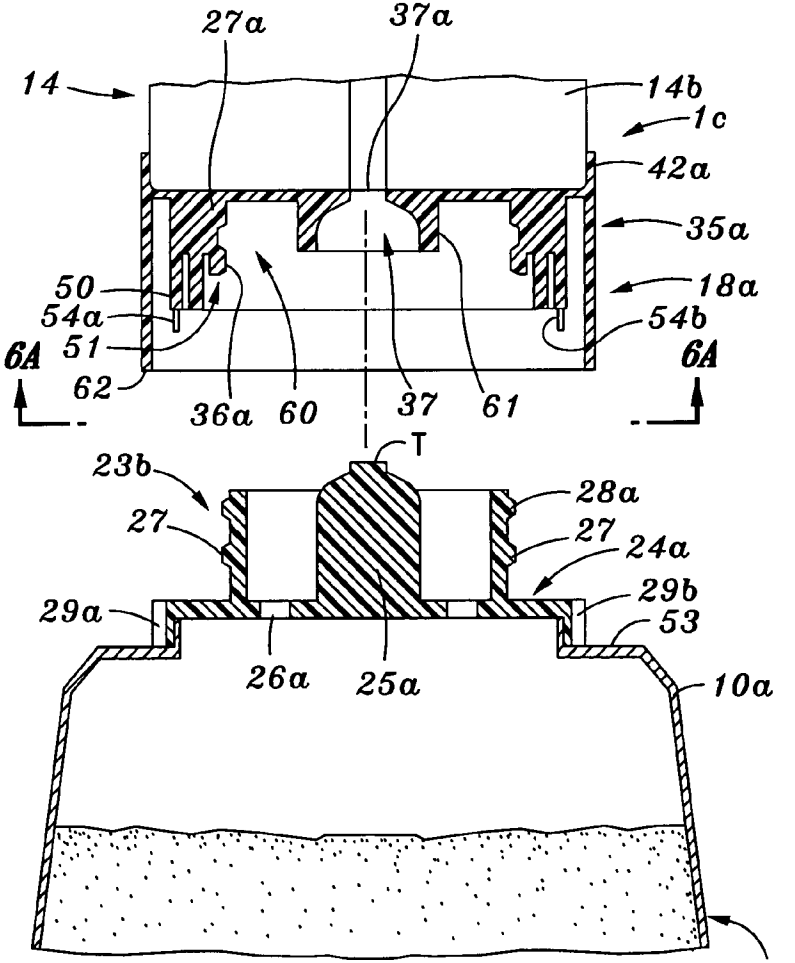
Figure 6B:
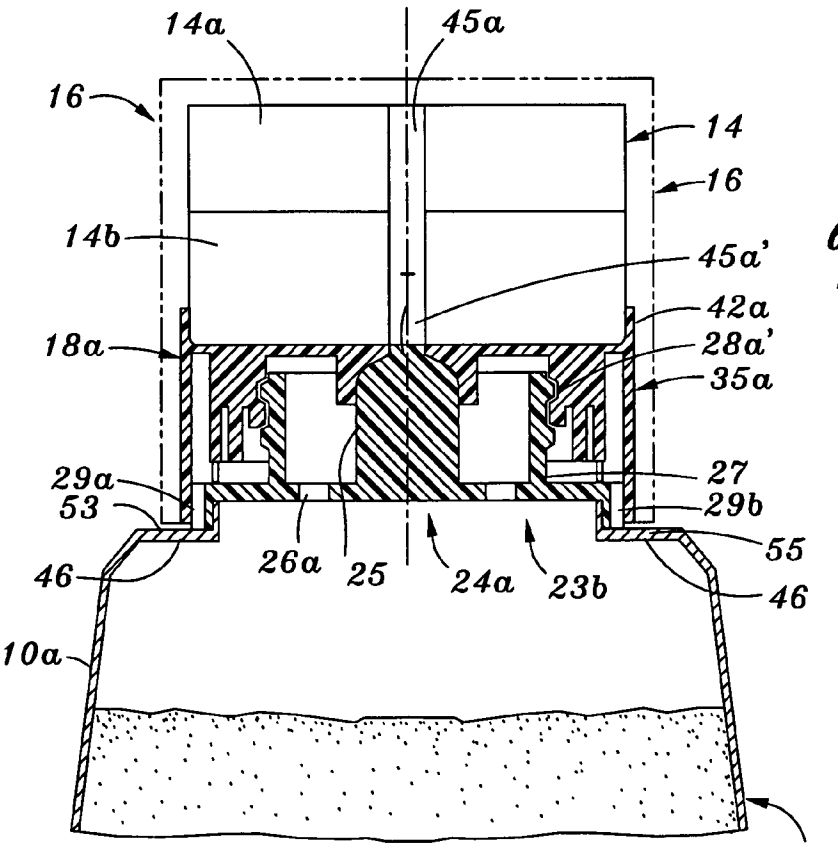

Depicted in FIGS. 6A through 6D is another embodiment of the present invention using a conventional dispenser cap 18*a* modified to accommodate an applicator 14 and a top enclosure 16 (shown in phantom line in FIG. 6B) in accordance with this invention. In this embodiment, a base member 23*b* of the cap 18*a* is bonded to the upper end 10*a* of the container 10 and a cover member 35*a* is mounted to rotate with respect to the base member. This base member 23*b* has the same basic components as the base member 24 depicted in FIGS. 3 and 3A (thought shaped differently) and it also has a few additional components that provide an audible signal upon opening and closing the cap 18*a*. Moreover, the assembly of the cover member 35*a* and attached applicator 14 may disconnected from the base member 23*b* as shown in FIG. 6C. Upon attachment of the base member 23*b* and cover member 35*a*, threads 28*a* on an outside surface of a cylindrical wall 27 of the base member 23*b* engage threads 36*a* on the inside surface of a cylindrical wall 27*a* forming a cavity 60 in the cover member 35*a*. The base member 23*b* includes holes 26*a*, and the cover member 35*a* includes a cover opening 37*a*, so that, when opened, fluid material flows through the dispenser cap 18*a* and into the applicator 14. When the dispenser cap 18*a* is closed, the opening 37*a* is sealed by a base plug 25*a* being pushed into a domed pocket 37*s* in which the cover opening 37*a* is centered. A tip T of the base plug 25*a* is equal in diameter to the cover opening 37*a* and lays flush with the top surface of the cover member 35*a* when sealed as shown in FIG. 6B. Upon placing the top enclosure 16*a* over the closed dispenser cap 18*a*, the end 45*a*' of a solid enclosure pin 45*a* abuts the tip T of the base plug 25*a* and does not extend into the opening 37*a*, but the end 45*a*' of the pin 45*a* (FIG. 6B) is pressed firmly against the tip T of the base plug 25*a*.

As best illustrated in FIG. 6A, the cover member 35*a* includes a series of concentric annular walls 62, 50, 51 and 61. The wall 61 partially forms the pocket 37*s*. A stop mechanism is employed to limit the rotation of the cover member 35*a*. Nevertheless, with sufficient force, the consumer may override this stop mechanism and detach the cover member as shown in FIG. 6C. This stop mechanism includes upward projecting raised protrusions or stop members 29*a* and 29*b* on the base member 23*b* and a pair of clickers 54*a* and 54*b* located along an edge of the ring 50 the cover member 35*a*. The stop members 29*a* and 29*b* may be triangular in shape and are located on top of a flat horizontal portion 53 of the base member 23*b*. The stop members 29*a* and 29*b* are oriented such that two of its angled sides comprise a raised protrusion face tangentially to the circumference of the base member 23*b* and they are high enough so they make contact with the clickers 54*a* and 54*a* when aligned therewith.

The stop members 29*a* and 29*b* interact with the clickers 54*a* and 54*b* to provide a tactile and audible signal to the consumer that continued rotation will either detach the cover member 35*a* or attached the cover member to the base member 23*b* in a sealed relationship. The clickers 54*a* and 54*b* are low enough to pass over the raised protrusions 29*a* and 29*b* with continued rotation. When the cover member 35*a* is either being attached or detached, one of the clickers, clicker 54*a* or 54*b* depending on the rotational direction, brushes against the raised protrusion 29*a* and the consumer can feel this engagement as he or she is rotating the cover member 35*a*. As the consumer continues twisting, a clicker 54*a* or 54*b*, as the case may be, is bent and then released to make a "click noise" as it passes over a raised protrusion and snaps back into place. This "click noise" is an audible signal indicating to the consumer that the cover member 35*a* is securely attached to or detached from the base member 23*b*.

FIGS. 7 Through 7I

The embodiment of the dispenser of this invention depicted in FIGS. 7 through 7I includes multiple barriers or seals that inhibit or prevent leakage, for example, mating annular elements. As shown in FIGS. 7 and 7A, this dispenser includes a cap 18*y* covered by a top enclosure 16*y* similar to the top enclosures used in the embodiments discussed above. The main difference is that the top enclosure 16*y* includes a central, hollow, cylindrical pin 45*y* with an outwardly extending annular projection P1 (FIG. 7F) on its exterior surface near an open distal end 45*x* of the pin. This projection P1 extends into a mating annular recess R1 on the inside surface of a cylindrical wall 80 of the cap 18*y*. The longitudinal axis of the pin 45*y* is co-extensive with the central, longitudinal centerline or axis X of the dispenser of this embodiment.

Figure 7B:
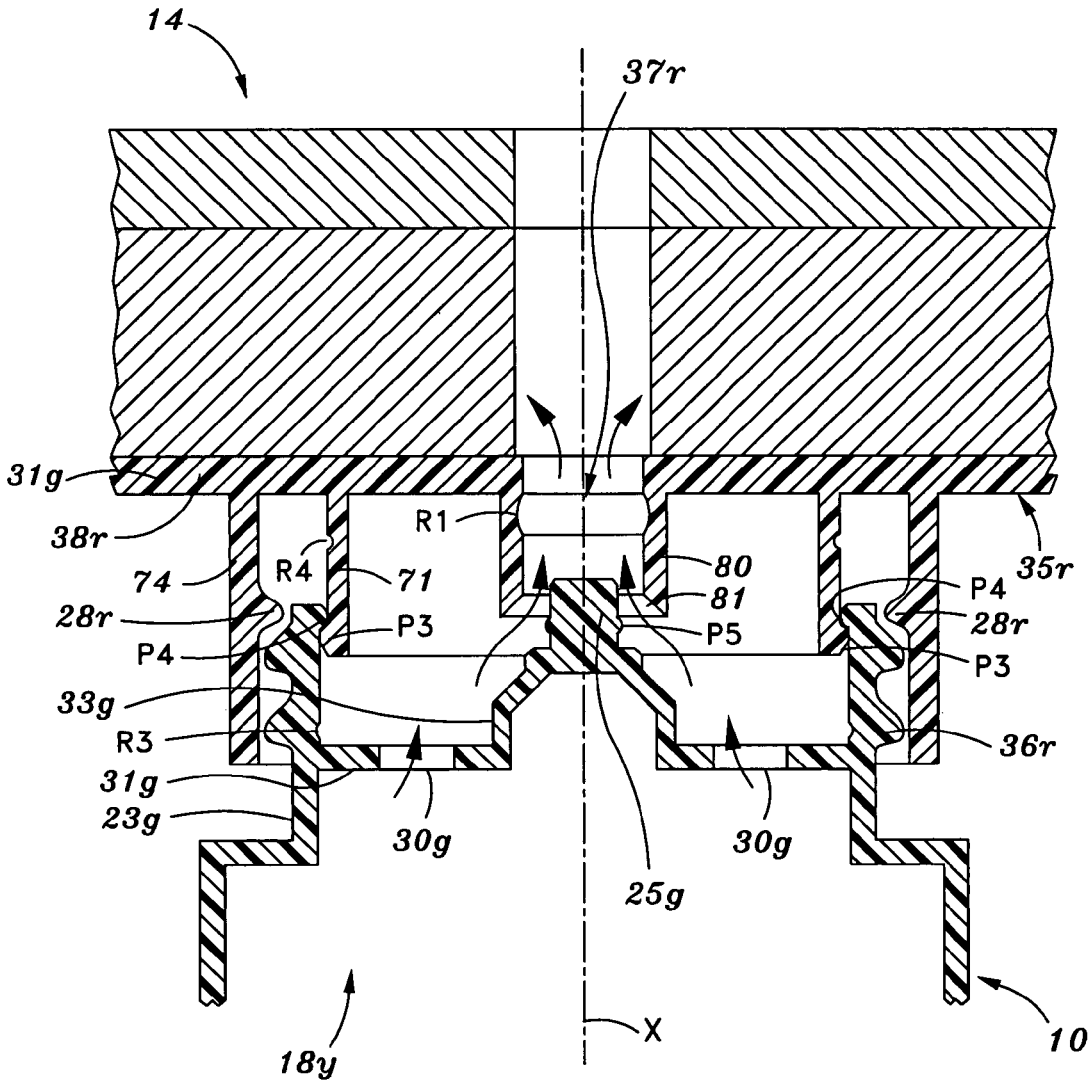
FIG. 7B is a cross-sectional view of the dispenser cap shown in FIG. 7A in an open position and with a top enclosure detached.

The cap 18*y* includes a cover member 35*r* that is detachably connected to a base member 24*g* by the matching sets of threads 28*r* and 36*r*. The threads 28*r* are on an inside surface of a cylindrical wall 74 of the cover member 35*r* and the threads 36*r* are on an outside surface of a cylindrical wall 23*g* of the base member 24*g*. The cover member 35*r* can be rotated back and forth between a normally closed position (FIG. 7A) and an open position (FIG. 7B). The base member 24*g* may be connected to the flexible container 10 by a conventional bonding technique and is immovable. The wall 74 is of a length and the threads 28*r* are configured so that an adequate travel distance is provided for raising and lowering the cover member 38*r* to enable the cover member 35*r* and the base member 24*g* to interact and seal as subsequently discussed.

The cover member 35*r* has a generally cylindrical configuration and includes a circular top wall 38*r* with a central, circular opening 37*r* and a cylindrical outer sidewall 41*r* along an outer edge of the top wall 38*r*. The outer sidewall 41*r* is substantially perpendicular to the top wall 38*r* and has an upper portion that extends above the top wall to form a lip 42*r* along the perimeter of the top wall 38*r* that surrounds a lower portion of the sponge applicator 14. The cylindrical wall 74 and two other cylindrical walls 71 and 80 extend down from the inside surface of the top wall 38*r*. All the walls 41*r*, 71, 74, and 80 are concentric with the axis X. The sidewall 41*r* is the longest of these walls and the wall 80 the shortest. As shown in FIGS. 7A and 7D, when the cap 18*y* is in the closed position, a free end 41*s* at a lower portion of the sidewall 41*r* of the cover member 35*r* is in very close proximity to the container 10 to provide a narrow gap G1 (FIG. 7D) between this free end 41*s* and the container 10. A lower end 16*s* of the top enclosure 16*y* terminates in an annular projection P2 that extends inward towards the axis X and fits into the gap G1. The projection P2 and the free end 41*s* interact to provide a catch mechanism for holding the top enclosure 16*y* on the cap 18*y* until the consumer pulls the top enclosure 16*y* off the cap 18*y*.

The cylindrical wall 80 of the cover member 35*r* has an inside diameter that is essentially the same as the diameter of the opening 37*r*. The outside surface of the wall 80 is smooth. As best shown in FIG. 7H and discussed subsequently in greater detail, the inside surface of the wall 80 has therein an annular recess R1 that assists in providing a seal when the cap 18*y* is in the closed position and enclosure 16*y* is secured in place shown in FIG. 7A. As best depicted in FIG. 7F, the wall 80 is sufficiently long that, when the cover member 35*r* is in the closed position, a beveled end 81 of the wall 80 engages a truncated conical wall 27*g* surrounding a central, cylindrical plug member 25*g* in the base member 24*g*. A leading edge of the beveled end 81 is angled so that it matches the slope of the tapered surface of the wall 27*g*. In the closed position, this beveled end 81 presses firmly against the wall 27*g*, thereby creating a seal or barrier that prevents or inhibits leakage.

The cylindrical wall 71 is between the walls 74*r* and 80 and is longer than the wall 80 and shorter than the wall 74. As best shown in FIG. 7G, a free end 71*a* of the wall 71 includes an outward extending annular projection P3 that interacts with an outward extending annular projection P4 in a cylindrical wall 23*g* of the base member 24*g*. (The wall 23*g* is also concentric with the axis X.) The projections P3 and P4 face each other and their interaction provides a stop mechanism that prevents the consumer from accidentally over rotating the cover member 35*r* and removing it inadvertently. The diameters of the walls 71 and 23*g* are such that the outer most edge of each projection P3 and P4 applies pressure against surface of the opposite wall. As best illustrated in FIG. 7I, when in the closed position shown in FIG. 7B, the annular projection P3 mates with an annular recess R3 in the inside surface of the wall 23*g*, fitting snug within this annular recess R3. The annular projection P4 mates with an annular recess R4 in the outside surface of the wall 71, fitting snug within this annular recess R4. This provides a dual seal that prevents or inhibits leakage between the walls. Additionally as depicted in FIG. 7I, when the cap 18 is in the closed position the wall 71 is primarily sealed by the projection P3 pressing firmly into the annular recess R3 and the projection P4 pressing firmly into the annular recess R4.

When the cover member 35*r* is rotated counter-clockwise as viewed in FIG. 7C, it moves from the completely closed position towards the completely open position shown in FIG. 7B. The threaded surfaces 28*r* and 36*r* of the cover member 35*r* and the base member 24*g* cause the projection P3 to slide along a spiral path upward along the smooth inside surface of the wall 23*g* until it makes contact with the projection P4 as shown in FIG. 7G. At this point the unimpeded twisting motion will be stopped. When the projections P3 and P4 initially engage upon rotating the cap 18*y* into the open position shown in FIG. 7B, the consumer feels a resistance against any further rotation. Nevertheless, the consumer can overpower the stopping action of the initially engaged projections P3 and P4 by applying additional force to detach the cover member 35*r* from the base member 24*g*.

As best shown in FIGS. 7C and 7H, the base member 24*g* includes a top wall 31*g* with four holes 30*g* surrounding the plug member 25*g*. The axis X is substantially perpendicular the top wall 31*g* and intersects the center of the top wall 31*g* and the center of the plug member 25*g*. A short cylindrical sidewall 33*g* that is substantially perpendicular to the top wall 31*g* connects the angled wall 27*g* to this top wall 31*g*. The plug member 25*g* extends outward from the top wall 31*g* towards the opening 37*r* in the wall 38*r* of the cover member 35*r*. In the closed position (FIG. 7A) the plug member 25*g* is inserted into the opening 37*r* to block it and prevent fluid material from escaping through this opening 37*r*. As best shown in FIGS. 7A and 7F, the plug member 25*g* fits within the opening 37*r* when the dispenser is in the closed position (FIG. 7A), with there be just enough gap between the top of the plug 25*g* and the opening 37*r* to allow for the pin 45*y* to fit therein. In the closed position, an annular projection P5 on the exterior surface of the sidewall of the plug member 25*g* mates with an annular recess R5 near the open distal end 45*x* of the hollow pin 45*y*, fitting snugly within the annular recess R5.

In this embodiment the holes 30*g* are not sealed. Rather, when the dispenser cap 18*y* is in the closed position (FIG. 7A), the fluid material within the container 10 can fill a cavity C1 (FIG. 7A) but can escape no further. This is because the cavity C1 is sealed on all sides (except the holes 30*g* which allow the contents to pass between the container 10 and cavity C1). The cavity C1 is sealed around its outer circumference by the cylindrical walls 71 and 23*g* (the gap between these walls is also sealed by the protrusions P3 and P4 discussed above). The diameter of the outer circumference created by walls 71 and 23*g* is sufficient so that the holes 30*g* are within its perimeter. This seal is effective whether the cap 18*y* is in the open or closed position. Additionally in the closed position (FIG. 7A), this cavity C1 is sealed off from cover opening 37*r* by the seal between wall 80 and the wall 27*g* of the base plug member 25*g* as follows: As depicted in FIG. 7F, the wall 80 is primarily sealed by the plug member 25*g* being pushed into the opening 37*r* and the projection P5 pressing firmly into the annular recess R5 of the enclosure 16*y*. As illustrated in FIG. 7A, the wall 74 terminates in an end 74*r* that abuts a flat ledge 29*g* of the base member 24*g* when the cap 18*y* is in the closed position to provide a barrier that further inhibits any leakage.

The dispenser shown in FIGS. 7 through 7I functions in a manner similar to the embodiments discussed above but has the improved sealing features discussed above. Initially the top enclosure 16*y* covers the cap 18*y* and the pin 45*y* extends into the opening 37*r* with the plug member 25*g* inserted into the open distal end 45*x* of the pin. The cap 18*y* is in the closed position initially (FIG. 7A) and a tight seal is formed by, among other things, the annular projection P1 fitting snug within the annular recess R1, the annular projection P3 fitting snug within the annular recess R3, the annular projection P4 fitting snug within the annular recess R4, and the annular projection P5 fitting snuggly within the annular recess R5. With the enclosure 16*y* attached to the closed cap 18*y* if the enclosure 16*y* is rotated by the consumer, the projection P2 will freely turn within the gap G1 while the cover member 35*r* will not turn relative to the base member. Thus, the consumer cannot accidentally twist the enclosure 16*y* to open the cap 18*y* when he or she is simply attempting to remove the enclosure and not open the cap. Thus, as discussed above, multiple barriers or seals are provided that prevent or inhibit leakage of fluid material from within the container 10 when the cap 18*y* is closed.

Figure 10:
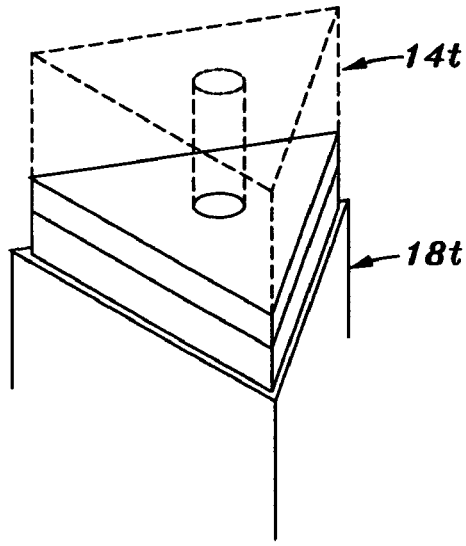
FIG. 10 is a perspective view of an alternate embodiment of the dispenser of this invention employing a dispenser cap and applicator having a triangular shape.

FIGS. 10 Through 12

Figure 11A:
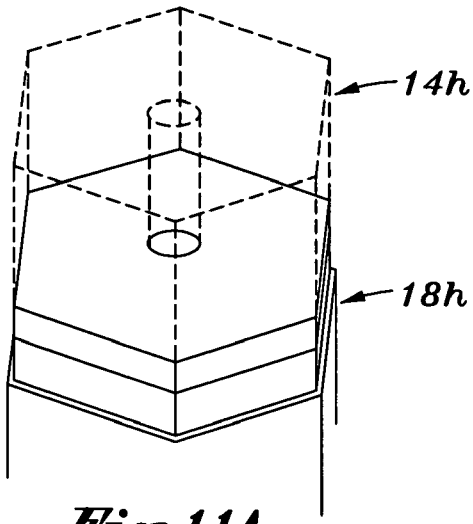
FIG. 11A is a perspective view of an alternate embodiment of the dispenser of this invention employing a dispenser cap and applicator having a hexagonal shape.
Figure 11B:
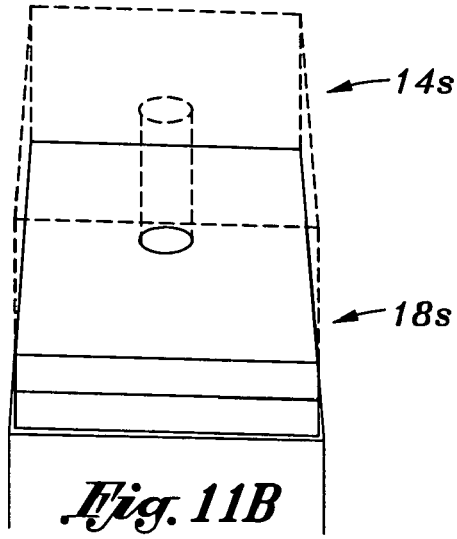
FIG. 11B is a perspective view of an alternate embodiment of the dispenser of this invention employing a dispenser cap and applicator having a square shape.
Figure 11C:
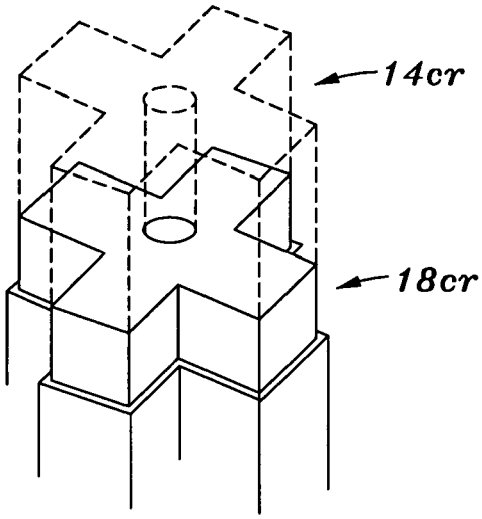
FIG. 11C is a perspective view of an alternate embodiment of the dispenser of this invention employing a dispenser cap and applicator having a cross shape.
Figure 12A:
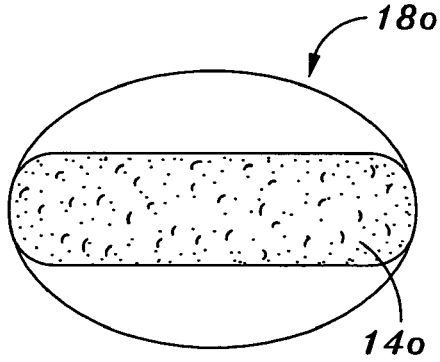
FIG. 12A is a plan view of an alternate embodiment of the dispenser of this invention employing a dispenser cap and applicator having an oval shape with the dispenser cap in a closed position.
Figure 12B:
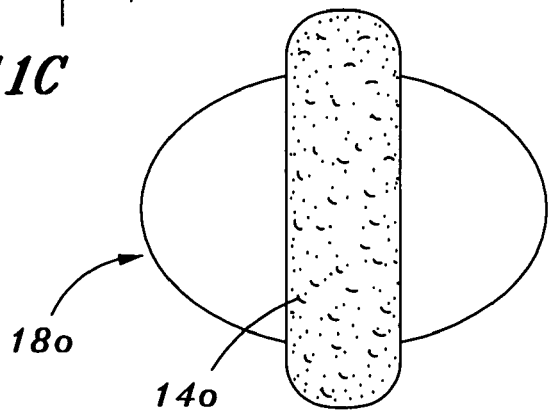
FIG. 12B is a plan view of the dispenser cap shown in FIG. 12A in an opened position.

In the alternate embodiments shown in FIGS. 10 through 12B, an applicator that is able to absorb the fluid material in the container 10 is used to apply this material to whatever the consumer wishes. Depending on the particular fluid material being dispensed and/or the particular application, the applicator may be a soft, porous material such as foam plastic such as, for example, open cell polyurethane foam; it may be made of several different types of materials in multiple layers or otherwise; and it may have several different shapes. FIGS. 10 through 12 depict some alternate shapes for the applicator, such as: a triangular shaped applicator 14*t* (shown in phantom) mounted on a triangular shaped dispenser cap 18*t* as depicted in FIG. 10; a hexagonal shaped applicator 14*h* (shown in phantom) mounted on a hexagonal shaped dispenser cap 18*h* as depicted in FIG. 11A; a square shaped applicator 14*s* (shown in phantom) mounted on a square shaped dispenser cap 18*s* as depicted in FIG. 11B; a cross shaped applicator 14*cr* (shown in phantom) mounted on a cross shaped dispenser cap 18*cr* as depicted in FIG. 11C; and an oval shaped applicator 140 mounted on a oval shaped dispenser cap 18*o* depicted in FIGS. 12A and 12B. The dispenser caps 18*t*, 18*h*, 18*s*, 18*cr*, and 18*o* are similarly in construction and function to the cylindrical dispenser cap 18. The oval shaped applicator 140 has the added advantage that its position indicates whether the cap is open (FIG. 12B) or closed (FIG. 12A).

FIGS. 13A Through 13C

The embodiment of this invention, dispenser 1*e*, depicted in FIGS. 13A through 13C employ an applicator 150 using stiff bristles 152 which may have triangular cross-sectional configuration. The applicator 150 comprises a substantially flat support member 154 and a plurality of stiff bristles 152 projecting outward from this support member substantially at a right angle to the support member. As shown in FIG. 13B, the support member 154 has a circular shape with a diameter substantially identical to the diameter of the cover lip 42*a* of the cover member 35.

The cover lip 42*a* provides a receptacle portion 42*b*' and the support member 154 is configured to fit snugly into the receptacle portion yet enabling the applicator 150 to be detached. The support member 154 may have a diameter slightly greater than the diameter of the receptacle portion 42*b*' and be force fitted into this receptacle portion and not easily removed therefrom. The support member 154 may have a diameter about equal to the diameter of the receptacle portion 42*b*' with an adhesive surface that bonds the applicator 150 to the cover member 35. As shown in FIG. 13C, an extra applicator 150*b* may be provided with the dispenser 1*e* that has a removable cover sheet 156 covering the adhesive surface. The cover sheet 156 is removed when the extra applicator 150*b* is used to replace the applicator 150 when it wears out.

FIGS. 14A Through 14C

The embodiment of this invention, dispenser If, depicted in FIGS. 14A through 14C employs a blow molded container 10*b* that is highly flexible and is substantially identical in shape to the container 10 illustrated in the other embodiments. In blow molding, a lower end LE of the container 10*b* is initially open, and subsequently closed and sealed after filling the container 10*b* with the fluid material to be dispensed. The lower end LE of the container 10*b* may include an eyelet 8. The eyelet 8 allows a seller to display the dispenser of this embodiment in a number of ways: (1) by hanging it upside down, or (2) resting on the top surface 75 of the enclosure 16. Displaying the dispenser near the point of sale may be advantageous. The inclusion of an eyelet is not limited solely to the blow molded dispenser If but may be included in any previous or subsequent dispensers, and would have the same functions and benefits.

When using blow molding, a hollow dispensing end DE of the container 10*b* is too flexible to support a cap 18*d* and must be made more rigid. The dispensing end DE includes a hollow stepped cylindrical member 107 and a threaded wall 108 which forms a cavity 102. The cap 18*d* is functionally substantially identical to the caps of the embodiments discussed above and, for example, may employ the cover member 35*r* with the dispensing end DE having an exterior like that of the base member 24*g*. The main difference is the lack of the rigidity of the dispensing end DE that must be accommodated. To achieve this, an additional component, a rigid insert 100, is employed. This rigid insert 100 typically is an injected molded, hard plastic. The insert 100 and the dispensing end DE are each designed so that there matching surfaces are congruent. Thus when the insert 100 is placed on the dispensing end DE the insert sidewall 104 fits snugly within the cavity 102 and the cylindrical member 107 fits snugly within a hollow tower 11 of the insert 100. The side of the insert 100 facing the cover member 35*r* has an external configuration substantially like that of the external surface of the base member 24*g*. In other words, the rigid insert 100 upon insertion into the cavity 102 forms in the dispensing end DE a mating surface capable of mating with an internal surface of a cover member 35*r* of the cap 18*d*.

In this embodiment, the rigid insert 100 includes a floor F3 that merges with the sidewall 104. From floor F3 projects a central, stepped, cylindrical, hollow tower 11. In the floor F3 are holes a1 and a2 that, upon inserting the rigid insert 100 into the cavity 102, are to be aligned with holes a3 and a4 in a floor F4 of the cavity 102. These holes a1, a2, a3 and a4 correspond to the holes 30*g* in the base member of the dispenser shown in FIG. 7A. The tower 11 has an interior cavity 11*a* with a configuration substantially identical to the stepped cylindrical member 107, and it receives this stepped cylindrical member upon inserting the rigid insert 100 into the cavity 102. The dispensing end DE and the insert 100 fit snug together so the insert does not turn within the cavity, and thus mate to form the base member. The rigid insert 100 in the cavity 102 imparts structural strength to the dispensing end DE and thus provides a rigid cap 18*d* with a cover member 35*r* that can be rotated about a base member similar to the other embodiments discussed above.

FIGS. 15A Through 15C

The embodiment of this invention, dispenser 1*g*, illustrated in FIGS. 15A through 15C depicts a dispenser employing a container 10 having a cap 18*e* including an applicator 14*e* having a plurality of orifices 101 therein and a top enclosure 16*e* with a plurality of parallel pins 45*e* extending longitudinally at substantially a right angle to the interior surface of the top wall 16*a* of the enclosure. With the top enclosure 16*e* seated on the dispenser's cap 18*e* as shown in FIG. 15C, the individual pins 45*e* have passed through individual orifices 101 thus sealing them. The top enclosure 16*e* is detached prior to dispensing the contents of the container 10.

The cap 18*e* includes a cover member 106 and the base member 23*b* like that shown in FIG. 7A. The cover member 106 is similar to the cover member shown in FIG. 7A except that it has a higher lip 42*e* defining a receptacle portion 109*e* in the cover member 106. As discussed above in connection with the embodiment shown in FIGS. 7 through 7I, the cover member 106 is at the dispensing end of the container 10 and mounted to rotate relative to the base member 23*b* so that in a first position the flow of fluid material from the container 10 is prevented and in a second position the flow of material from the container is allowed. The individual pins 45*e* block the orifices 101 upon attaching the enclosure 16*e* to the cap 18*e*, so if the cap is left open accidentally, spills are avoided or inhibited.

The applicator 14*e* comprises a dome top wall member 103 integral with a cylindrical sidewall 105. The dome shaped top wall member 103 has a diameter slightly greater than or equal to the outside diameter of the cover sidewall 42, while the applicator 14*e* sidewall 105 has a diameter slightly less than the diameter dome shaped top wall 103, but equal to or slightly greater than the internal diameter of the cover sidewall 42. Thus the applicator 14*e* is configured to fit snug within the receptacle portion 109*e* with an overhanging edge 108*e* that abuts the top of the lip 42*e* when the applicator 14*e* is forced into the receptacle portion 109*e* of the cover member 106. With the applicator 14*e* inserted into the receptacle portion 109*e*, a chamber is formed that holds fluid material as it is dispensed from the container 10. The dome top wall member 103 with the plurality of orifices 101 therein form, at least in part, a passageway 15*e* extending through the cap 18*e*. Other portions of the passageway 15*e* include the central opening 37*a* in the cover member 106 and the holes 26*a* in the base member 23*b*. Thus, with the top enclosure 16*e* detached and the cap 18*e* in an open position, fluid material flows from the container 10 through the holes 26*a*, out the central opening 37*a* into the chamber 109*e*, and then out the orifices 101 covering the exterior surface of the dome top wall member 103.

FIG. 16

The embodiment illustrated in FIG. 16 holds a plurality of applicators. As depicted in FIG. 16, a sponge applicator 14*b* is mounted to the top outer surface S2 of the cover top wall 38 in a manner that allows it to be removed easily. In this embodiment, extra sponge applicators 14*c* and 14*d* are stored in an enlarged top enclosure 16*d*. The applicator 14*b* and the extra applicators 14*c* and 14*d* each have an exterior, bottom surface coated with a low-tack adhesive to facilitate easy removal. The low-tack adhesive surfaces of the extra applicators 14*c* and 14*d* are each covered with a removable sheet 19 that is stripped away when the applicator 14*b* is to be replaced. The extra applicators 14*c* and 14*d* are approximately the same size and shape as the applicator 14*b* and each applicator 14*b*, 14*c*, and 14*d* has a longitudinal passageway 15*a*. These passageways 15*a* are aligned when the applicators 14*b*, 14*c*, and 14*d* are stacked upon each other as shown in FIG. 16. A central, elongated pin 45*b* projecting inward from the inside surface of the top of the enclosure 16*d* extends through the aligned passageways 15*a* and engages the cap 18 as discussed above.

FIGS. 17A Through 17D-Paint Merchandising Method

Any of the embodiments of the dispensers discussed above may be used to dispense paint according to the paint merchandising method of this invention. In accordance with this method, the container 10 used has only a limited capacity, for example, about 3 to 6 ounces, typically no more than about 8 ounces. For illustration purposes, the dispenser 1*a* having such a limited capacity container 10 will be discussed in connection with a paint merchandising method of this invention. This method helps consumers select a color of paint that works best for what they need.

FIGS. 17A through 17D illustrate one scenario using the dispenser 1*a* where the container 10 holds only a small quantity of paint, that is, (a) enough paint to allow a consumer to see the paint color after being applied to an object, e.g. any surface, or (b) to perform touch up work. The paint dispenser 1*a* may include one or more means imprinted on the container 10 (FIG. 1) of identifying the color of paint contained within the container, for example: A text description 10*e* (palm tree green), a numerical representation 10*n*, and a barcode representation 10*bc*. The consumer can use the first two representations, text 10*e*, and numerical 10*n*, to order larger quantities of the paint contained within the paint dispenser 1*a* by either phoning in the information (FIG. 17C) or entering it through an online ordering system over a global computer network (the internet). Alternatively, the consumer can bring in the dispenser 1*a* and have a salesperson scan the barcode 10*bc* (FIG. 17D) using a conventional bar code reader 85.

FIG. 17A shows a consumer 80 discussing with a salesperson 87 the purchase of paint and the selection of paint colors available. The consumer 80 may select multiple dispensers 1*a*, each holding a different paint color. These dispensers 1*a* may be purchased or given as a courtesy sample, for example, 2 or 3 dispensers 1*a*, each containing a different color paint. The consumer 80 brings these paint dispensers 1*a* to wherever a surface 83 is that he or she wishes to paint. The consumer 80, using the dispensers 1*a*, applies the paint in as big or small a swatch 90 as he or she needs to be able to determine which color they prefer. To apply the paint to the surface 83, the costumer first removes the top enclosure 16, rotates the cap 18 into the open position, and then squeezes the container 10, filling the applicator 14 with paint. Next, the consumer places the applicator 14 on the surface 83 to be painted and compresses the applicator to release the paint from the applicator as the consumer moves the applicator across the surface 83. Alternatively the consumer 80 may squeeze the container 10 simultaneously with the act spreading the paint. FIG. 17B depicts the consumer 80 in the process of applying three different colors to the desired surface 83. Upon completion of this task, the consumer will be able to judge which color looks best on the surface 83. Once the consumer 80 has decided on a best color, the consumer 80 may then call in an order (FIG. 17C) of the desired quantity of the selected paint color by reading either the name 10*t* or the numerical code 10*n* off the container 10. Alternatively, the consumer 80 may bring in container 10 and have an employee scan the barcode 10*bc* off the container 10 (FIG. 17D) and then mix up the desired quantity of the selected paint. Consequently, the method of this invention thus ensures convenience, consumer satisfaction, and simplicity in ordering paint.

SUMMARY

The above-described dispensers may be used to dispense a wide variety of fluid materials held within the container. Skin care products such as, for example, cosmetics, micro-dermal abrasive solutions, antiseptics, ointments, creams, topical solutions, etc. are suited to be applied to the skin of a person using the applicator attached to the cap, especially a sponge-type applicator. Deodorants may be applied using the embodiment illustrated in FIGS. 15A through 15C. Other fluid materials such as depilatory creams, shoe cleaners and polish, coatings such as, for example, paint, stains, varnish, liquid wax, many types of chemicals, etc. may be dispensed using this invention.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention:

The invention claimed is:

1. In combination, a cap for a dispenser of fluid material and an enclosure therefor, wherein said cap includes a base member adapted to be attached to an open end of a dispenser and having an outer edge and a centrally located plug element, a cover member having a top surface with an opening centrally located therein, an outer edge, and a raised element on the top surface along a periphery of said top surface, said opening and plug element being aligned, said cover member being mounted to rotate relative to the base member when said base member is attached to an open end of a dispenser, said cover member upon rotation in one direction moving between a closed position with the plug element inserted into the opening to prevent the flow of material from the cap and an open position with the plug element withdrawn from said opening to allow the flow of material from the cap, and upon rotation in a direction opposite to said one direction, moving between the open position and the closed position, an applicator element seated on the top surface and having an inside surface attached to the top surface with said raised element substantially surrounding at least a lower portion of the applicator element, said applicator element having a passageway therethrough aligned with said opening in the cover member, and said enclosure includes a closed top end, an open bottom end, an inward projecting retainer element at the bottom end enabling the enclosure to be detachably connected to the outer edge of the cover member or the base member, and an internal pin element attached to the top end and projecting inward towards the open bottom, said internal pin element having a predetermined length such that, with the enclosure attached to the cap and the retainer element engaging said outer edge of the cover member or the base member, the pin element extends through the passageway in the applicator element and blocks the opening in the cover member where the internal pin element has at an inner terminal end a wall defining a cavity and the opening has a groove substantially surrounding the opening, said wall fitting snugly into said groove when the members are in the closed position.

* * * * *